US006398323B1

(12) United States Patent
Lee

(10) Patent No.: US 6,398,323 B1
(45) Date of Patent: Jun. 4, 2002

(54) STORAGE SYSTEM

(76) Inventor: Furn Li Lee, Block 340 #12-1650, 1 Jurong East Avenue, Singapore (SG), 600340

( * ) Notice: Subject to any disclaimer, the term of this patent is extended or adjusted under 35 U.S.C. 154(b) by 0 days.

(21) Appl. No.: 09/509,157

(22) PCT Filed: Oct. 3, 1998

(86) PCT No.: PCT/SG98/00079

§ 371 (c)(1),
(2), (4) Date: Mar. 21, 2000

(87) PCT Pub. No.: WO99/17635

PCT Pub. Date: Apr. 15, 1999

(30) Foreign Application Priority Data

Oct. 6, 1997 (WO) ..... PCT/SG 97/00052

(51) Int. Cl.[7] ..... A47B 45/00
(52) U.S. Cl. ..... 312/205; 312/321
(58) Field of Search ..... 312/321, 321.5, 312/205, 3, 4, 5, 6, 273, 274, 127, 129, 311; 211/94.01, 105.1, 105.2, 105.3; 190/13 R, 14, 15 R, 21, 22

(56) References Cited

U.S. PATENT DOCUMENTS

| | | | | | |
|---|---|---|---|---|---|
| 842,821 A | * | 1/1907 | Tryon | ..... | 312/205 |
| 2,702,734 A | | 2/1955 | Kroll | ..... | 312/275 |

FOREIGN PATENT DOCUMENTS

| | | | | | |
|---|---|---|---|---|---|
| DE | 567 649 | | 1/1933 | | |
| FR | 529067 | * | 6/1954 | ..... | 312/321 |
| GB | 10437 | * | 5/1899 | ..... | 312/205 |
| GB | 7460 | * | 3/1911 | ..... | 312/274 |
| GB | 237044 | | 7/1925 | | |
| GB | 311354 | * | 4/1929 | ..... | 312/321 |
| GB | 377302 | | 7/1932 | | |

OTHER PUBLICATIONS

Patent Abstract JP 8–019433 (Shimizu Corp), Jan. 1996.

Patent Abstract JP 8–280455 (Kojima Kogei KK), Oct. 1996.

Patent Abstract JP 7–100020 A (Yamaguchi Hisao), Apr. 1995.

Patent Abstract JP 7–067760 A (Yutaka) Mar. 1995.

* cited by examiner

*Primary Examiner*—James O. Hansen
(74) *Attorney, Agent, or Firm*—Akerman Senterfitt

(57) ABSTRACT

A storage system for sheeted objects such as clothes, including a storage unit, formed of a first component and a second component, and a rail assembly which includes a main rail and an extension portion in the form of at least one pivotally or telescopically connected rail element. The element is adapted to be supported in an extended condition, externally of the first component, so as to increase the effective length of the rail assembly when the second component is in an open condition.

21 Claims, 20 Drawing Sheets

(a) PLAN VIEW (b) SECTION A–A (a) PLAN VIEW (b) PLAN VIEW (c) PLAN VIEW

PLAN VIEW (a) PLAN VIEW (b)

STORAGE SYSTEM

FIELD OF INVENTION

This invention relates to a storage system. More particularly, the invention relates to a storage unit or wardrobe having a hanging space which is reduced when the unit is closed, and increased when the unit is open. The invention has particular application to hanging sheeted objects such as clothes, towels, blankets, bed sheets, suspension files, paper documents, drawings and the like.

BACKGROUND OF THE INVENTION

A wardrobe for hanging clothes is a common piece of furniture found in almost every household. The traditional wardrobe has a fixed hanging space which cannot generally be utilised to its maximum capacity. As the number of clothes in the hanging space increases, it becomes increasingly difficult to take out the clothes or hang additional clothes on a clothes hanging rail. Additionally, if the clothes are hung as compactly as possible, it becomes difficult to browse through one's favorite clothes to make a selection of what to wear.

OBJECT OF INVENTION

It is an object of the invention to provide a system for hanging sheeted objects, such as clothes, which allows for compact storage and which allows for the hanging space to be increased for ease of browsing through, taking out or hanging the sheeted objects.

Other objects, features and advantages of the present invention will become apparent from the detailed description which follows, or may be learned by practice of the invention.

SUMMARY OF THE INVENTION

In accordance with the present invention, there is provided a storage system including:

a first component for providing a hanging space for receipt of sheeted objects;

a second component adapted to couple to the first component to define a storage unit and movable between an open and a closed condition; and a rail assembly including a main rail coupled to the first component at one end, for hanging the sheeted objects therefrom when the second component is in the closed condition and an extension portion coupled to the second component at the other end, the extension portion being extendible relative to the main rail upon movement of the second component toward the open condition, whereat the rail assembly is in an extended condition, so as to increase the effective length of the rail assembly and allow the sheeted objects to slide onto the extension portion in order to spread the sheeted objects along the rail assembly when the second component is in an open condition.

Preferably, the second component is moved to the open condition by rotating relative to the first component and includes a guide track for receiving a roller provided at an end of the extension portion, to allow the extension portion to extend linearly during relative rotation of the second component whilst maintaining coupling therebetween.

Preferably, the rail assembly comprises are articulated construction formed of at least one pivotally connected rail element. Preferably, a plurality of elements are provided, the elements being arranged to pivot in a substantially horizontal plane and fold into the space provided by the first component when the second component is in the closed condition. Alternatively, the at least one element is arranged to pivot in a substantially vertical plane.

Preferably, the first component comprises a rear panel, a side panel, and at least a roof portion of the unit and the second component is in the form of a front panel, pivotally attached to the first component and includes a side panel and another roof portion whereby, in a closed condition, the roof portions of the first and second components provide a full roof panel and preferably, the first component is pivotally attached to the second component by a hinge connection provided between the side panel of the first component and the front door panel of the second component. Alternatively, the first component includes a base panel and a rear panel, and the second component includes a front panel, hingedly attached to the base panel.

Preferably, the system includes a carriage assembly upon which the unit is mounted, the assembly allowing the unit to pivot from an upright to a horizontal orientation and to be subsequently horizontally displaced for storage. Preferably, the carriage assembly includes a platform, to which the unit is hingedly coupled for movement between the upright and horizontal orientations and guide rails along which the platform slides for it to effect horizontal displacement of the units.

Preferably, a second rail assembly is coupled to the first component and arranged to extend, when the second component is in an open condition, substantially parallel to the first rail assembly.

Preferably, the unit includes at least one panel arranged for movement to enhance access to the sheeted objects hanging within the unit and coupled to the second component via a linkage opening mechanism such that movement of the panel results in corresponding movement of the second component toward the open condition.

Preferably, the main rail of the rail assembly is supported at another end by a support member connected to the first component, the support member engaging the main rail from an underside thereof so as not to inhibit sliding movement of a hanger between the main rail and the extension portion.

Preferably, the extension portion is telescopically extendible relative to the main rail.

BRIEF DESCRIPTION OF THE DRAWINGS

This invention is more fully described, by way of non-limiting example only, with reference to the accompanying drawings, in which.

DETAILED DESCRIPTION OF PREFERRED EMBODIMENTS

Figure 1:
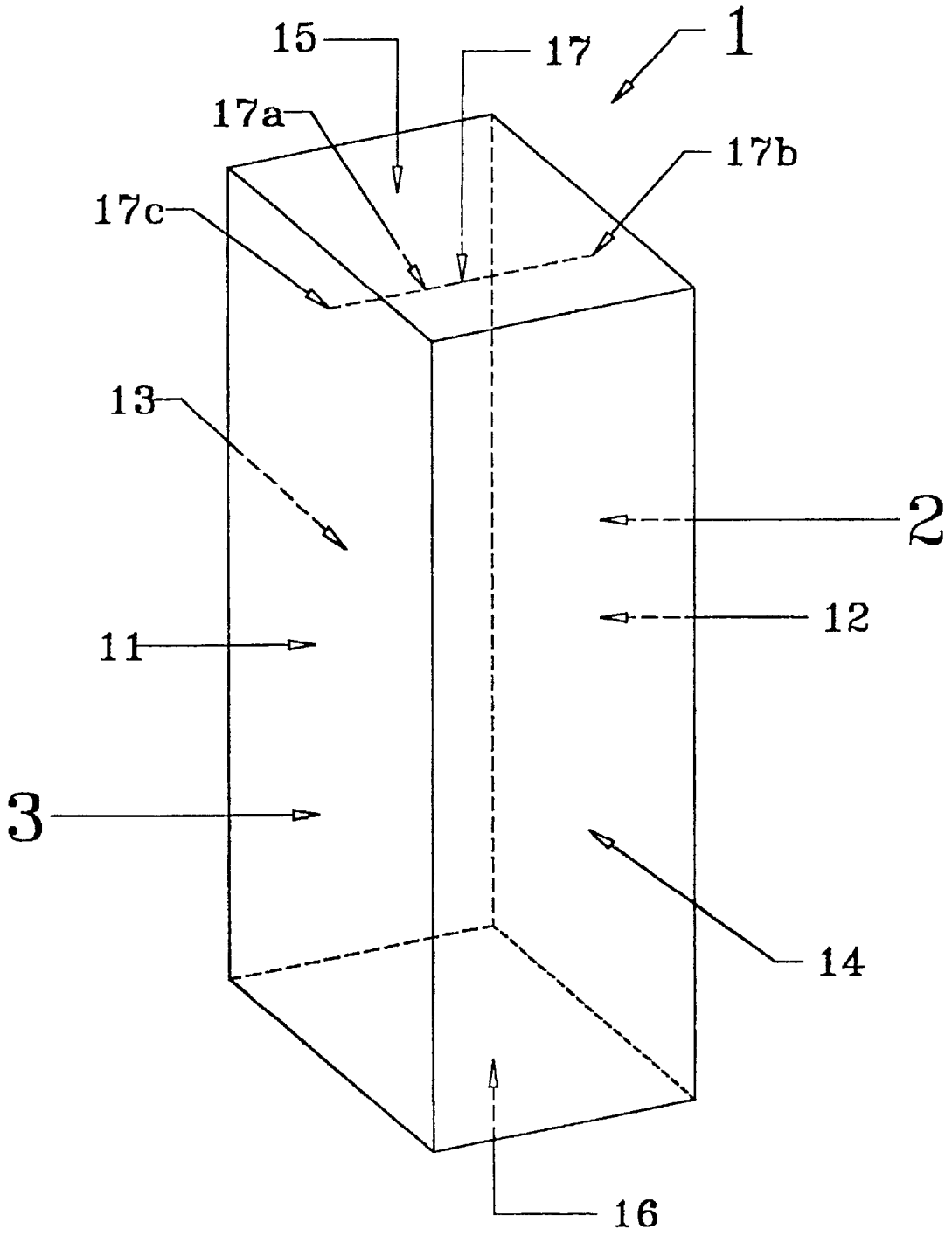
FIG. 1 is a diagrammatic perspective view of a first embodiment of a storage unit of the invention.

FIG. 1 shows a first embodiment of a storage unit (1), in the form of a wardrobe (10), in a fully closed condition. The unit (1) includes a first component (2) and a second component (3) coupled to the first component (2) and movable between an open and a closed condition. The unit (1) consists of a front panel (11), a back panel (12), two side panels (13, 14), a roof panel (15) and a base panel (16), forming a rectangular box-like structure, with the first component including at least the back panel (12), and the second component (3) including at least the front panel (11). The hanging space of the wardrobe in the fully closed condition is defined between the front (11) and back (12) panels. Within the said hanging space, there is a collapsible rail assembly (17) which is collapsed to fit into the said hanging space, such that only a main rail (17*a*) of the said rail assembly (17) spans across the said hanging space, and all the sheeted objects in the wardrobe are hung by hangers on this rail (17*a*) of the rail assembly (17) when the wardrobe is in fully closed condition. The rail (17*a*) is perpendicularly fixed to the back panel (12) at one of its ends (17*b*) and it is preferred to be fixed at mid-width of the back panel (12) so that the space within the wardrobe can be utilised most efficiently. End (17*b*) of the rail (17*a*) is also preferred to be fixed at a convenient vertical distance down from the roof panel (15) such that it is sufficient for hangers to be taken from and put on the said rail assembly (17) without obstruction. The other end (17*c*) of the rail (17*a*) is joined to an extension portion formed of pivotally coupled rail element (s) of the said rail assembly (17) such that when the wardrobe is in fully opened position, all the elements of the assembly (17) extend to form a continuous horizontal hanger rail. All the sheeted objects that are initially hung on the rail (17*a*) can then be spread over the extended rail assembly to increase the ease of taking out, putting in or browsing through objects on the rail assembly.

Figure 2A:
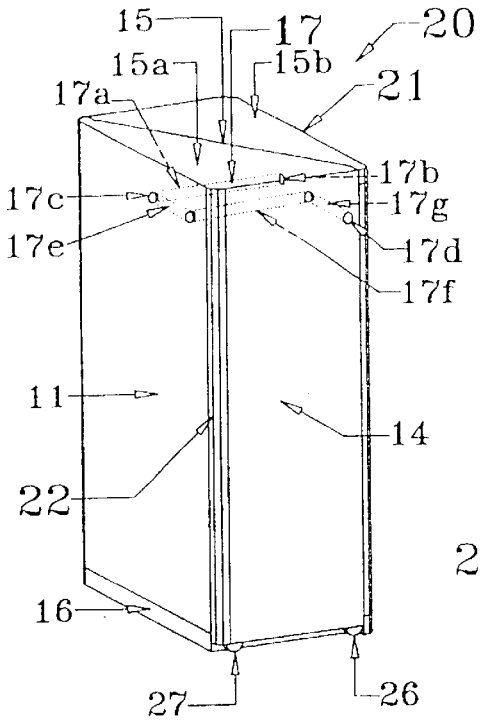
FIG. 2*a* is a perspective view of the unit of FIG. 1.
Figure 2B:
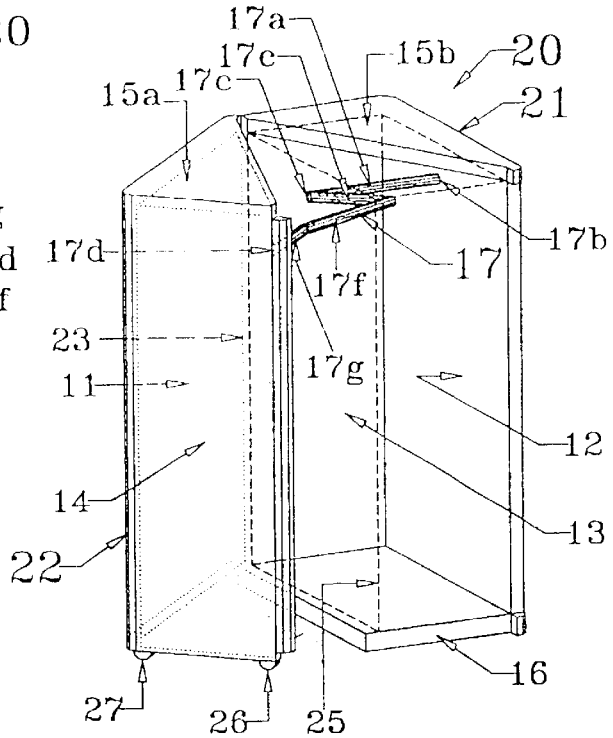
FIG. 2*b* is a perspective view of the unit in a partially opened condition.
Figure 2C:
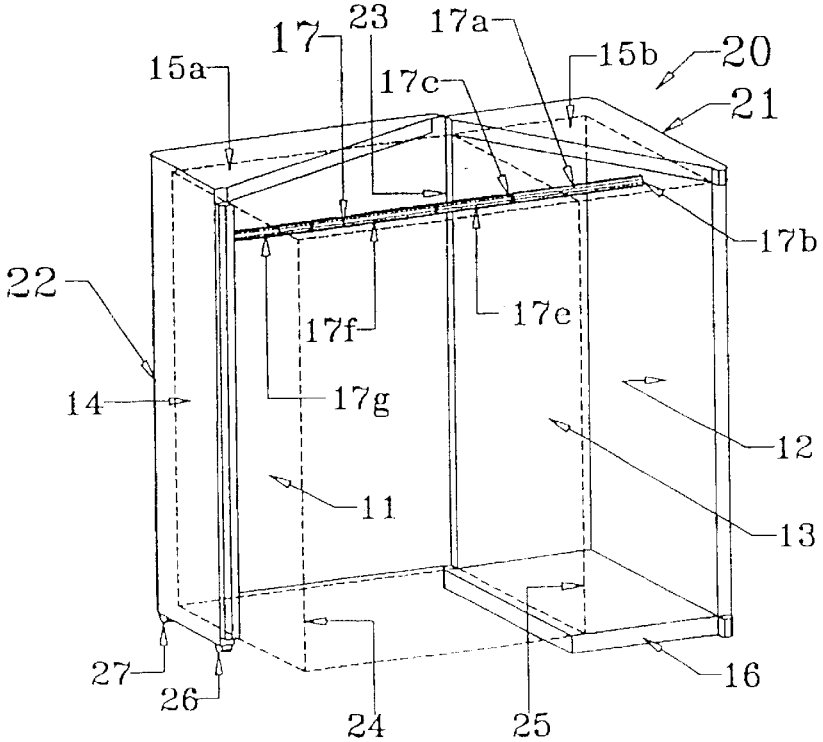
FIG. 2*c* is a perspective view of the unit in a fully opened condition.
Figure 3A:
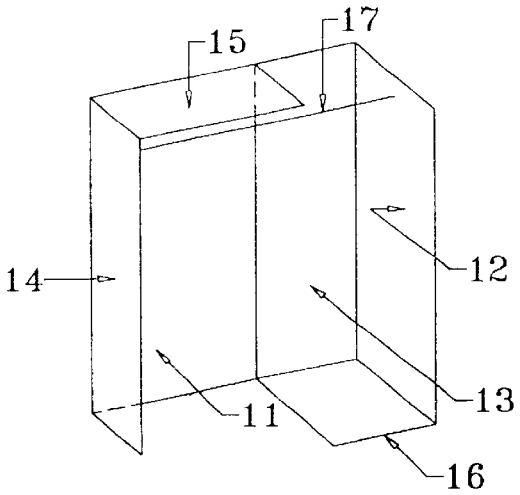
FIGS. 3*a* to 3*d* illustrate modifications to the roof of the unit.
Figure 3B:
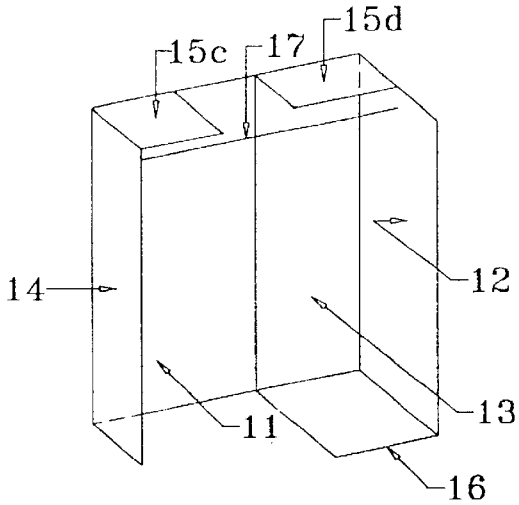
Figure 3C:
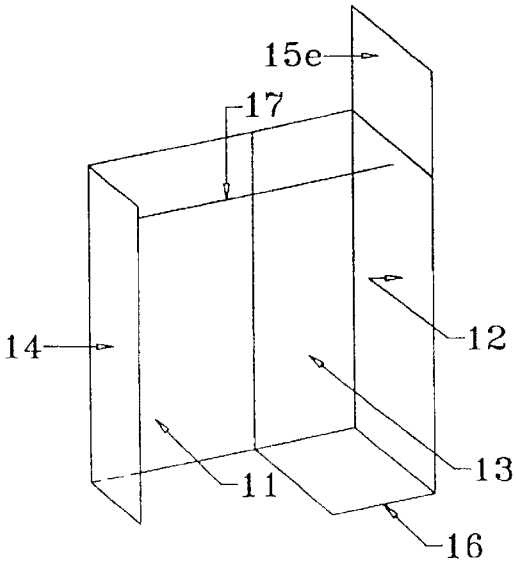
Figure 3D:
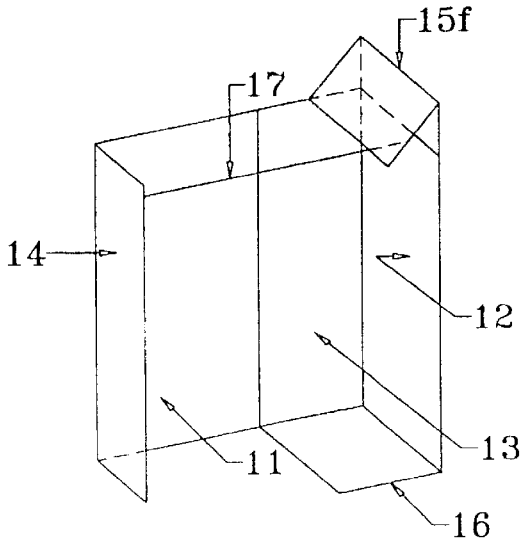

FIGS. 2*b* and 2*c* show one preferred embodiment of a storage unit or wardrobe (20) in a partially and fully opened condition, respectively. Basically, a first component (21) of this embodiment of wardrobe (20) consists of back (12), side (13) and base panel (16), and the second component comprises a door unit (22) which consists of front (11) and side (14) panel. The door unit (22) is joined to the first component (21) by a hinge (23) and when the wardrobe (20) is fully opened as shown in FIG. 2*c*, the front panel (11) is preferred to be parallel to the side panel (13) and naturally the side panel (14) will be parallel to the back panel (12), and the hanging space (24) is defined between the side (14) and back (12). The previously collapsed rail assembly (17) is now extended to form a continuous rail, with an element (17*d*) attached to the door unit, so as to span horizontally between side panel (14) and back panel (12). The roof panel (15) is preferably formed of two portions for enhancing accessibility and visibility to the clothes hung within the boundary (25) of the first component (21) when the wardrobe is in fully opened position. This is true when the wardrobe (20) height, i.e. the level of the roof panel (15), is substantially lower than the eye-level of the user. If this scenario occurs, it is preferred to have the roof panel (15) divided into two triangular roof portions (15*a* & 15*b*) such that one of them attaches to the first component (21) and the other one attaches to the door unit (22) as most clearly shown in FIGS. 2*b* and 2*c*. This will improve the accessibility and visibility to the clothes, as well as the aesthetic look. Of course, there are many other ways to increase the accessibility and visibility by changing the shape and position of the roof panel (15), for instance, the roof panel (15) can be formed of a single panel attached to door unit (21) as shown in FIG. 3*a*, or divided into two panels (15*c*) and (15*d*) as shown in FIG. 3*b*, or lifted up, as illustrated by the panel (15*e*) as shown in FIG. 3*c* or folded as shown by panel (15*f*) in FIG. 3*d*.

The collapsible rail assembly (17) for embodiment (20) should basically consist of the main rail (17*a*) with one end (17*b*) fixed to back panel (12) at a suitable position described previously, and an extension portion, including plurality of rail elements, such as rail element (17*d*) attached to side panel (14), at least when the wardrobe is in fully opened position. In one preferred embodiment, the element has its end (17*d*) permanently attached to side panel (14). In such a way, when the wardrobe is opened, the collapsible rail assembly (17) unfolds automatically following the position of door unit (22) as shown in FIG. 2*b* and eventually, when the wardrobe is in a fully opened condition, as shown in FIG. 2*c*, the collapsible assembly (17) is extended to form a continuous hanger rail, spanning between the side panel (14) and back panel (12). When the wardrobe is closed, the extension portion folds automatically relative to the door unit (22) and the main rail, following the position of the door unit (22), and eventually it collapses into the hanging space defined by the front panel (11) and back panel (12) when the wardrobe is in fully closed condition, leaving the element (17*a*) spanning across the hanging space. FIG. 2*b* shows the assembly (17) partially collapsed when the wardrobe is opened partially and FIG. 2*c* shows the assembly (17) fully extended when the wardrobe is in fully opened position. In order to achieve the above-mentioned folding, the assembly

(17) preferably consists of three elements (but may possibly be formed of, for example, four elements), one being the main rail (17*a*), and the other elements being hingeably connected to each other such that they translate and rotate in a horizontal plane when the wardrobe is opening or closing, and the extension element (17*d*) may be either hingeably connected or fixed to side panel (14). The element (17*e*) immediately attached to the main rail (17*a*) is preferred to locate at an angle as large as possible (largest being 90 degree which is a constraint imposed by the presence of the front panel (11)) away from rail (17*a*) when the wardrobe is in fully closed position to avoid interference of the element (17*e*) to hangers that are hung on the rail (17*a*). To achieve this requirement, the assembly (17) may have four elements.

Figure 4A:
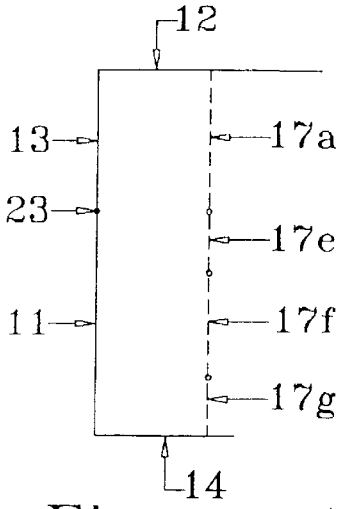
FIGS. 4*a* to 4*e* illustrate alternative constructions of a rail assembly of the unit.
Figure 4B:
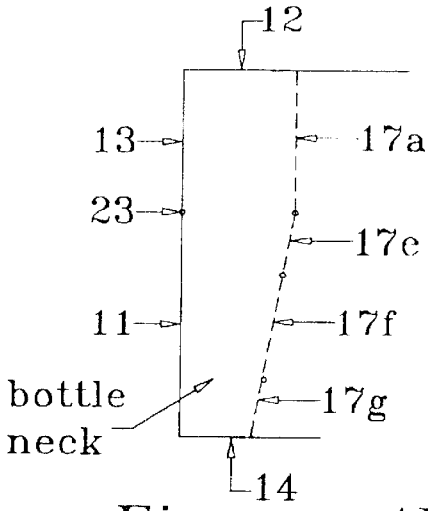
Figure 4C:
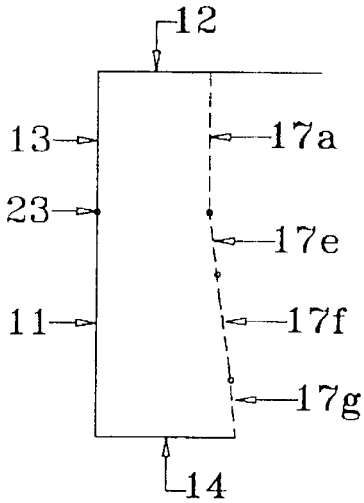
Figure 4D:
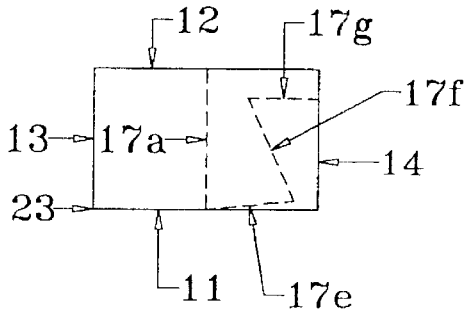

If the width of the side panels (13 and 14) is equal or more than half of the width of back panel (12), the assembly may consist of four elements (17*a*, 17*e*, 17*f* and 17*g*) as shown in FIG. 4*a*. The element (17*g*) is preferred to be attached to the side panel (14) at a distance equal to half the width of back panel (12) from front panel (11) to ensure a uniform hanging space that facilitates smooth sliding of the sheeted objects on hangers towards the direction of side panel (14) and it is preferred to locate at a height same level as end (17*b*). If the said element (17*g*) is located at a distance less than half the width of back panel (12) from the front panel (11), a bottle-neck will form towards the direction of side panel (14) as shown in FIG. 4*b*. Of course, smooth sliding of the sheeted objects on hangers towards the direction of side panel (14) can also be achieved if the end (17*d*) of the hanger rod (17) is attached to the side panel (14) at a distance more than half the width of back panel (12) from front panel (11), but the elements (17*e*, 17*f* and 17*g*) should be curved to fit in the profile (41) shown in FIG. 4*c*. When the rail assembly (17) is fully collapsed as the wardrobe is in fully closed position, it will roughly have the configuration shown in FIG. 4*d*.

Figure 4E:
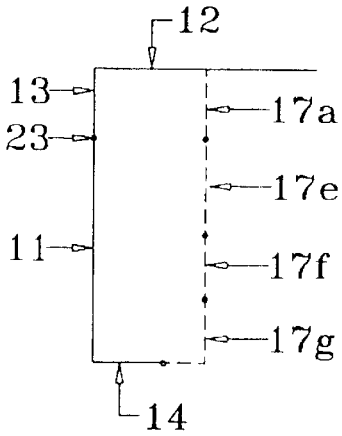
Figure 4F:
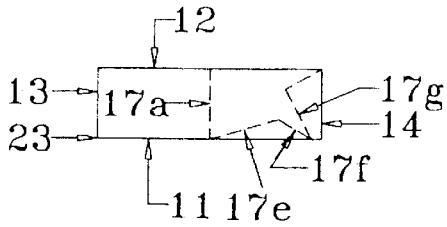

If the width of the side panels (13 and 14) is less than half the width of the back panel (12), the element (17*g*) may be of L-shape as shown in FIG. 4*e* and connected hingeably to side panel (14) in order to obtain a uniform hanging space when the hanging rod (17) is fully extended as the wardrobe is in fully opened condition. When the assembly (17) is fully collapsed as the wardrobe is in fully closed position, it will roughly have the configuration shown in FIG. 4*f*. As a result, the length of each element of the collapsible assembly (17) should meet the following criteria:

- rail (17*a*) should be long enough to span across the hanging space defined by front (11) and back panel (12) when the wardrobe is in fully closed position,
- the total length of all the rail and the other three elements (17*e*, 17*f* and 17*g*) should be enough to span horizontally across the hanging space defined by the side (14) and back panel (12) from end (17*b*) to end (17*d*) when the wardrobe is in fully opened position,
- the length of each element (17*e*, 17*f* and 17*g*) should be adjusted so that they will collapse into the hanging space when the wardrobe is in fully closed position and none of them should interfere the hangers hung on the main rail element.

Figure 5A:
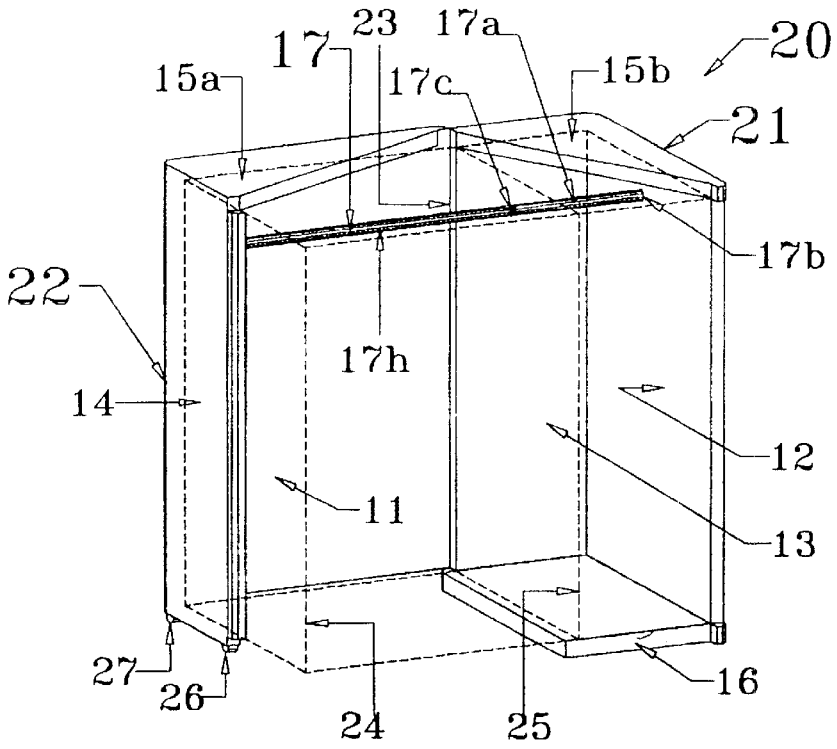
FIGS. 5*a* to 5*b* illustrate another alternative construction of the rail assembly.
Figure 5B:
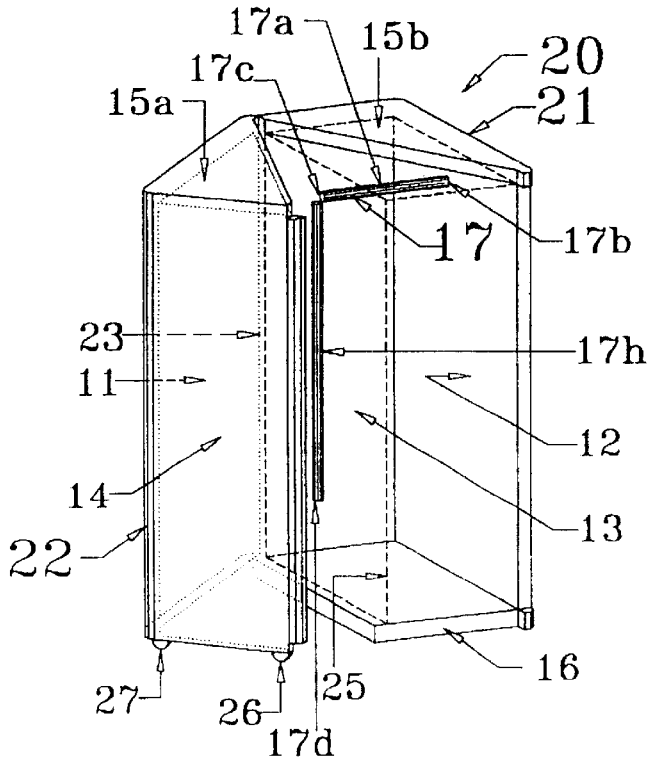

FIGS. 5*a* and 5*b* show another possible configuration of the assembly (17) for a wardrobe in a fully opened and partially closed position respectively. The assembly (17) consists of two elements, being main rail (17*a*) and element (17*h*). Element (17*h*) is hingeably connected to rail (17*a*) and rotatable along a vertical plane parallel to side panel (13). When the wardrobe is in fully opened position, the element (17*h*) will be lifted up and its end (17*d*) will be rested on a predetermined location on side panel (14) so that the rail and element (17*h*) form a continuous hanger rail spanning horizontally across the hanging space defined between side (14) and back panel (12). Before the wardrobe is closed, the element (17*h*) must be lowered from engagement with the side (14) such that it hangs freely, after which the wardrobe can be closed. It can be seen that the embodiment with the assembly (17) in the configuration shown in FIG. 5 is simpler to build but it requires more steps to open and close the wardrobe.

The arrangement of sheeted objects within the wardrobe should be such that when the wardrobe is in a fully closed position, all the objects should be hung on the main rail (17*a*). When the wardrobe is opened, the objects still remain hanging on rail (17*a*) until the wardrobe is in fully opened condition, in which instance the collapsible rail assembly is full extended to form a continuous hanger rail. The sheeted objects may then be spread along the extended assembly (17). This increases the ease with which the sheeted objects may be taken out, put in or browsed through. Before the wardrobe is closed from a fully opened condition, all the objects must be pushed back onto the rail (17*a*), i.e. all the hook parts of the hangers must be hooked on rail (17*a*) because the extension portion collapses during closing of the wardrobe. At this instance, some of the objects that are hung near the end (17*c*) of rail (17*a*) may not necessarily be within the hanging space of wardrobe defined when the wardrobe is in fully closed condition. Accordingly, as the door unit (22) is closing, it will push all the sheeted objects so that they will be all within the hanging space when the wardrobe is in the fully closed condition. In such a way, the sheeted objects are able to be stored in a very compact manner.

It is preferred that the door unit (22) be supported by some means which rests on the ground in addition to the hinge (23). This is because when the wardrobe (20) is in fully opened position and the sheeted objects are spread across the extended rail assembly (17), the center of gravity of the wardrobe will be shifted to around the center of the hanging space (24) which will create a overturning moment to the wardrobe. If the door unit (22) is not supported, the wardrobe may be overturned unless the first component (21) is firmly attached to a fixed position, even though, the hinge (23) which joins the door unit (22) and first component (21) will experience a great force. Therefore, it is preferred that the door unit (22) be supported in addition to the hinge (23). One possibility is to attach a pair of wheels (26) and (27) to the side panel (14) as shown in FIG. 2.

Figure 6A:
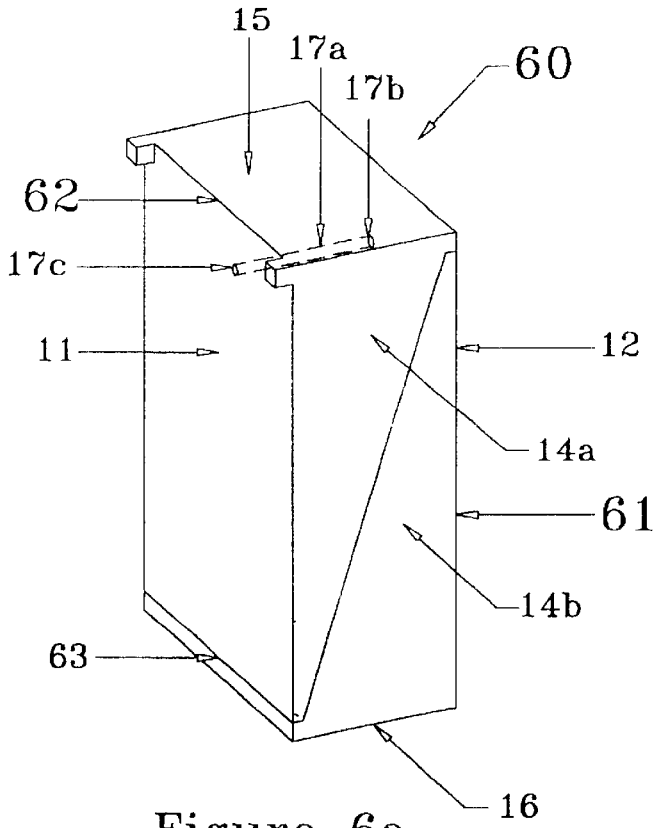
FIG. 6*a* is a perspective view of a second embodiment of a storage unit of the invention.
Figure 6B:
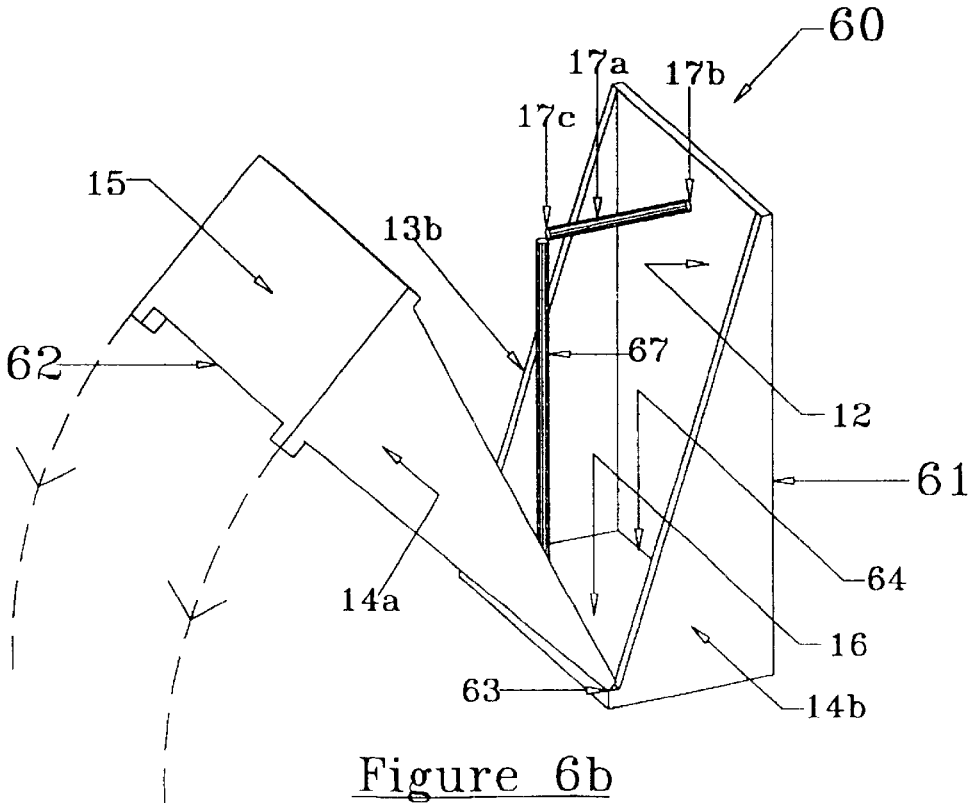
FIG. 6*b* is a perspective view of the unit of FIG. 6*a* in a partially opened condition.
Figure 6C:
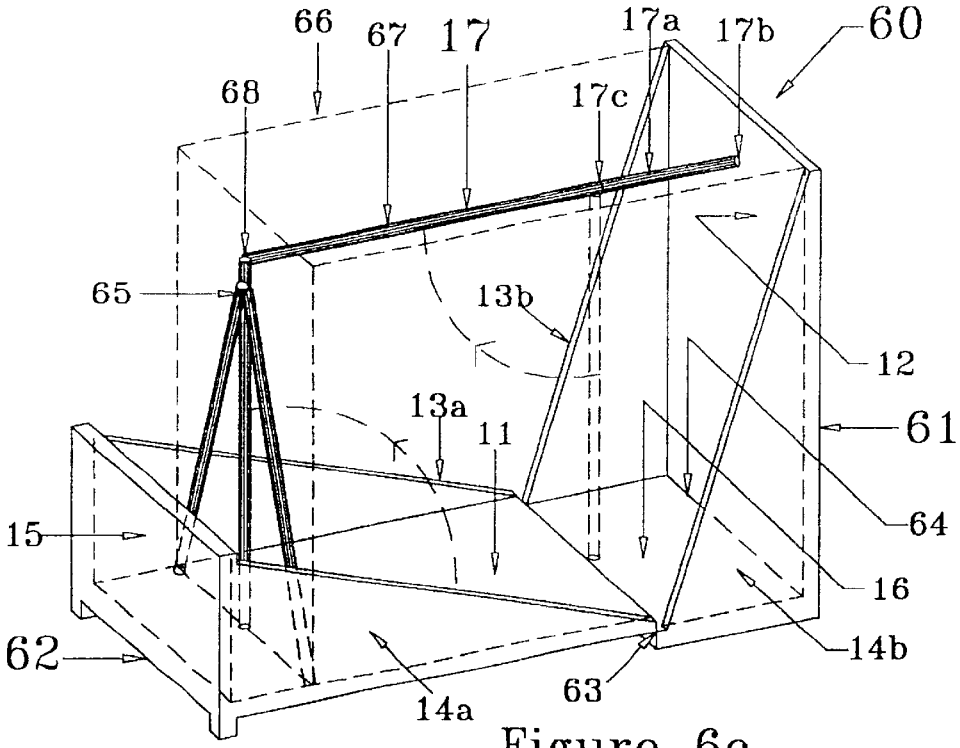
FIG. 6*c* is a perspective view of the unit of FIG. 6*a* in a fully opened condition.

Another embodiment (60) of the invention is illustrated in FIGS. 6*a* to 6*c*, which show the wardrobe in a closed, partial and fully opened position respectively. The wardrobe (60), in the fully closed condition, provides a structure which is similar to embodiment (10) shown in FIG. 1. Basically, the first component (61) consists of a back panel (12) and base panel (16) and the second component, or door unit (62), consists of the front panel (11). The door unit (62) is hingeably connected to the base panel (16) along horizontal axis (63), and the front panel (11) is preferably in a horizontal position when the door unit (62) is fully opened. The roof panel (15) is preferably attached to the front panel (11) for the purpose of having better accessibility and visibility to sheeted objects when the wardrobe (60) is in the fully opened position. And for the same reason the two side panels (13 and 14) are also preferably attached to the front panel (11). This, of course will cause the first component to be structurally weaker because it only comprises the base panel (16) and back panel (12), which are joined together along the horizontal axis (64) and extra side panels (13 and 14), in two equal triangular portions, may be provided—where portions (13*a*) and (14*a*) attach to the second component and portions (13*b*) and (14*b*) attach to the first component. This will stiffen the first component and at the same time will not reduce the accessibility and visibility to the objects. Of course, the shape of the divided side panels (13 and 14) may vary as required. A support stand (65) is required to support the rail assembly (17), and therefore, the hanging space (66) of the wardrobe (60) in a fully opened position is defined between the support stand (65) and back panel (12) as shown in FIG. 6*c*.

Figure 6D:
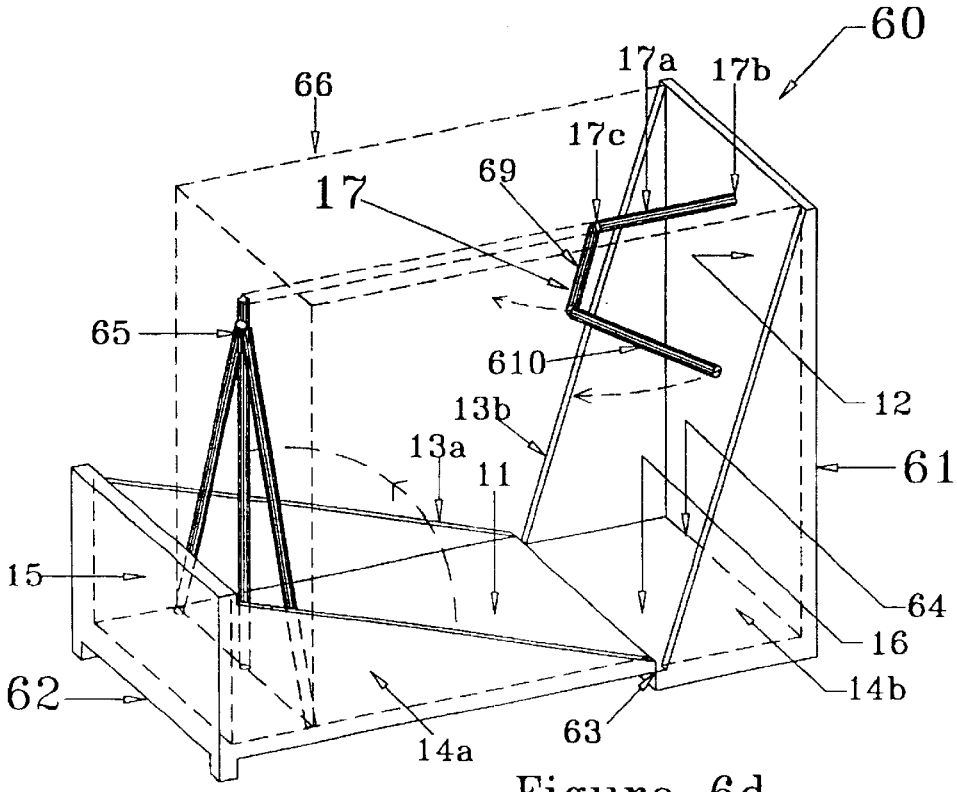
FIG. 6*d* is a perspective view of the unit of FIG. 6*a*, with a modified rail assembly, in a fully opened condition.

The rail assembly (17) may consist of a main rail (17*a*) and an extension portion in the form of element (67). Element (67) is hingeably connected to rail (17*a*) and rotatable along a vertical plane parallel to side panel (13). When the wardrobe is in fully opened, the hanger element (67) may be lifted up and its end (68) rested on top of the support (65) as shown in FIG. 6*c* so that the rail (17*a*) and element (67) form a continuous hanger rail spanning horizontally across the hanging space (66) defined between the support (65) and back panel (12). Of course, the rail assembly can be of other configurations, for instance, a three-element-hanger-rod as shown in FIG. 6*d* where the main rail (17*a*), and elements (69) and (610) of the rail assembly (17) are hingeably connected to each other, of which elements (69) and (610) translate and rotate in a horizontal plane. Regardless of the configuration of the rail assembly (17), the total and individual length of the rail and elements making up the assembly (17) should span over the hanging space defined both when the wardrobe is in fully opened position and collapse into the hanging space defined when the wardrobe is in fully closed position.

Basically the sheeted object storing and retrieving procedure is the same as for embodiment (20) except one more extra step is needed to raise the support stand (65) into a vertical position first before the rail assembly (17) is extended to form a continuous horizontal hanger rail when the wardrobe is in a fully opened position, and the end (68) of assembly (17) has to be rested on the top of the support stand (65). Vice versa, the support stand (65) must be lowered down before the wardrobe is closed.

Figure 7A:
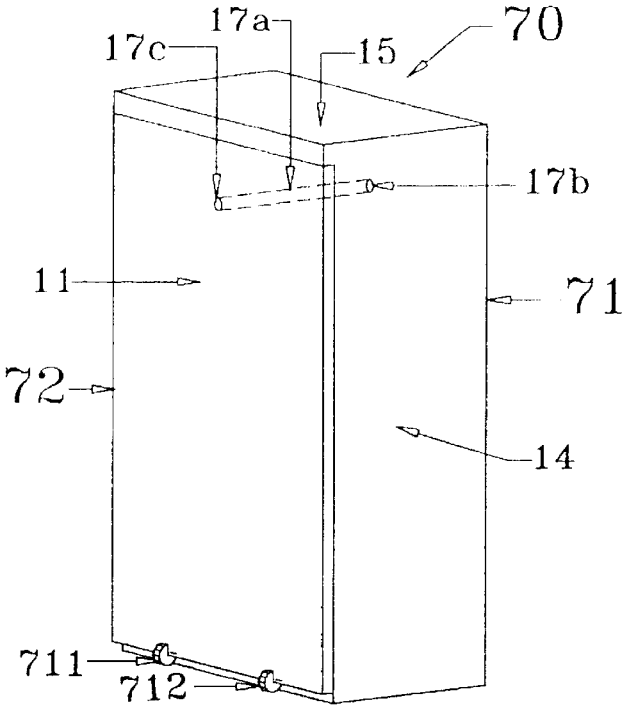
FIG. 7*a* is a perspective view of a third embodiment of a storage unit of the invention.
Figure 7B:
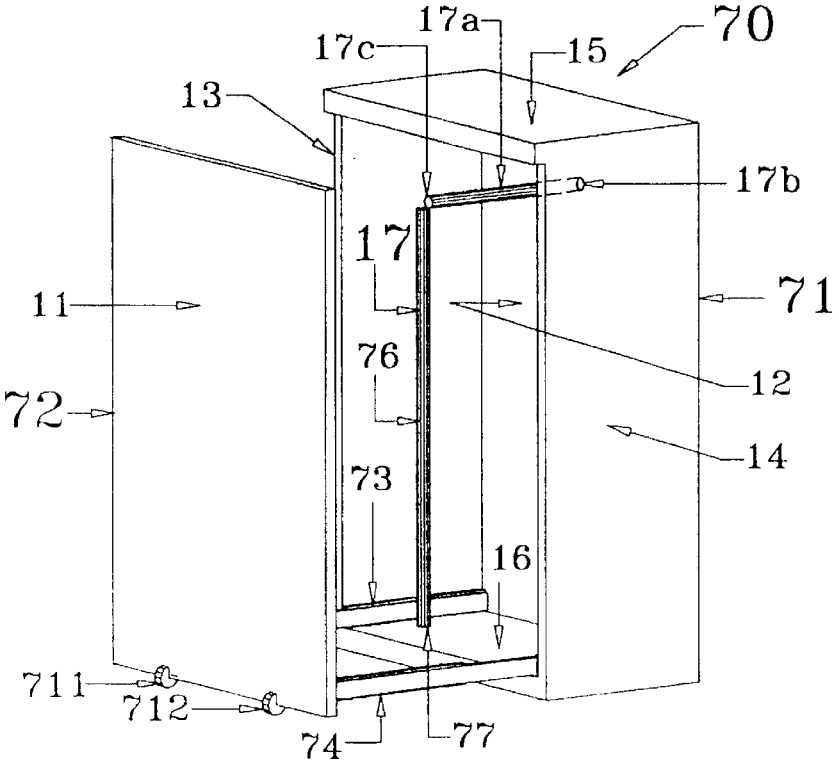
FIG. 7*b* is a perspective view of the unit of FIG. 7*a* in a partially opened condition.
Figure 7C:
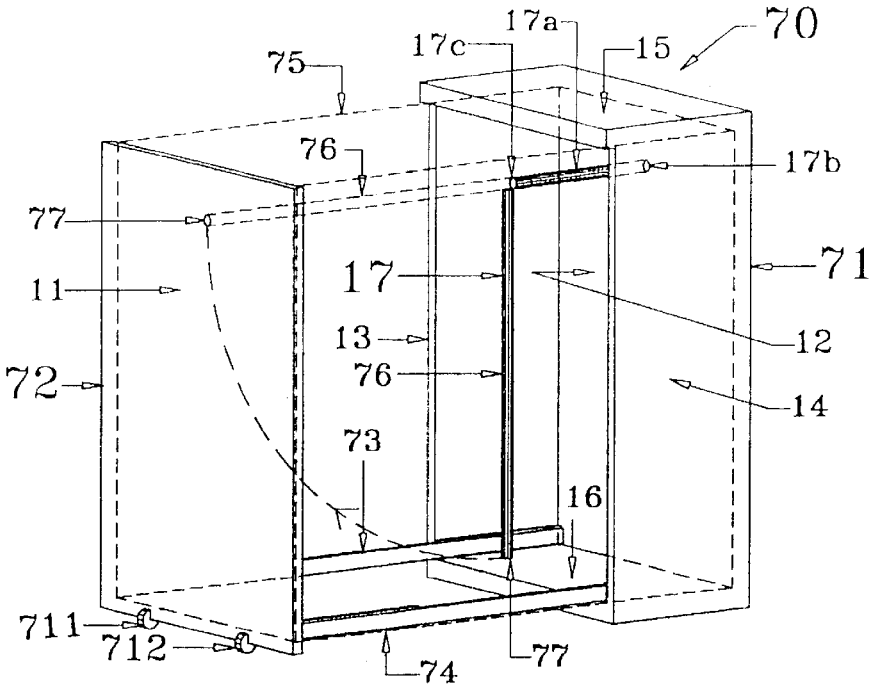
FIG. 7*c* is a perspective view of the unit of FIG. 7*a* in a fully opened condition.
Figure 7D:
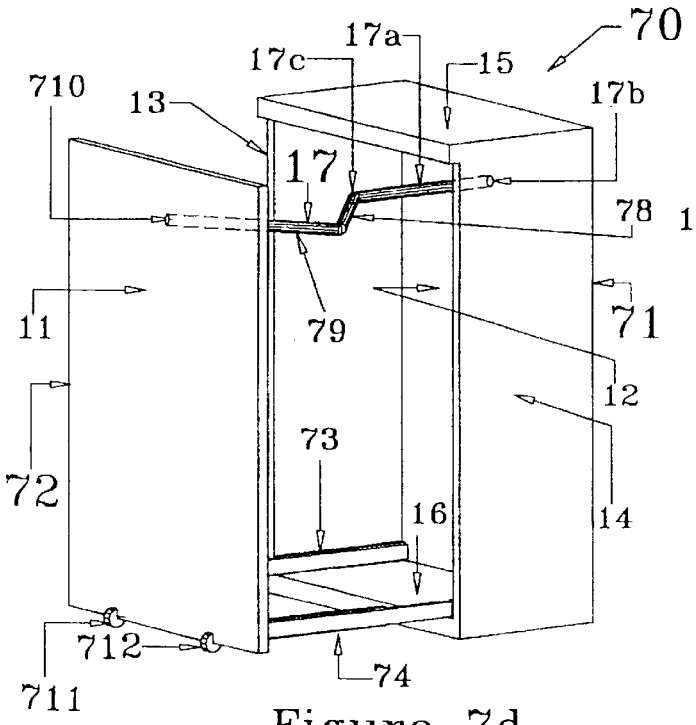
FIG. 7*d* is a perspective view of the unit of FIG. 7*a*, with a modified rail assembly, in a partially closed condition.
Figure 7E:
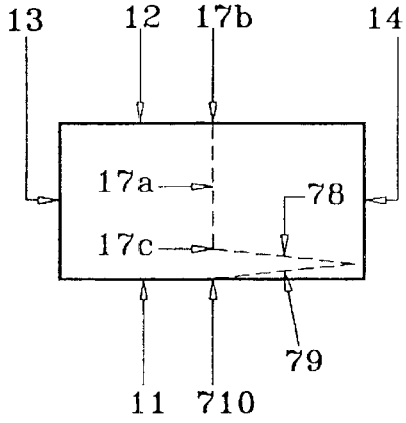
FIG. 7*e* is a diagrammatic plan view of the unit of FIG. 7*e*, in a closed condition.

Another embodiment (70) of the invention is illustrated in FIGS. 7*a* to 7*c* which show the wardrobe in a closed, partial and fully opened position respectively. The wardrobe (70), in the fully closed condition, provides a structure which is similar to embodiment (10) shown in FIG. 1. The wardrobe (70) includes a first component (71) which consists of a roof panel (15), base panel (16), side panels (13, 14) and back panel (12), the second component/door unit (72) consists of the front panel (11). The door unit (72) is opened along the axis perpendicular to the back panel (12) and is guided along two track runners (73 & 74) fixed perpendicularly to back panel (12). In fully opened position, the hanging space (75) is defined between the front (11) and back panel (12) with the assembly (17) forming a continuous rail, spanning horizontally across the said space where a larger hanging space is obtained. The collapsible assembly (17) must consist at least two portions, one being a main rail (17*a*), and the other being an extension portion in the form of rail element hingeably connected (or connected by other convenient means that enable the assembly to be collapsible) to the rail (17*a*). The element is preferably allowed to hang freely about a hinge connected to end (17*c*) of rail (17*a*),when the wardrobe is closing and in the fully closed position, as shown in FIG. 7*b*. When the wardrobe is in fully opened position, the element (76) will be rotated to a horizontal position about the hinge to form a continuous rail and end (77) of element (76) rested on the front panel (11), preferably at mid-width of panel (11) and at a height of same level as end 17(*b*). The collapsible rail assembly may of course consist of more than two portions, say main rail (17*a*), and elements (78) and (79), as shown in FIG. 7*d*. The end (710) of the element (79) can be fixed to the panel (11) permanently, and each element is hinged so as to translate and rotate within a horizontal plane. In this way, when the wardrobe (70) is opening, the rail assembly will be extended automatically and eventually extend fully to form a continuous hanger rail when the wardrobe is in fully opened position. Vice versa when the wardrobe is closing, the hanger rod will be collapsed automatically and allow the wardrobe to be closed fully. The arrangement of the fully collapsed hanger rail assembly (17) when the wardrobe is in fully closed position should be similar to that in FIG. 7*e*. It is preferred that a pair of wheels (711) and (712) be attached to the front panel (11). as shown in FIG. 7, to prevent the wardrobe from being overturned by the moment created by the door unit (72) when the wardrobe is in opened position.

When the wardrobe is in a fully closed condition, in the form of the box-like construction of embodiment (10), all of the sheeted objects may be compacted within the hanging space. The wardrobe may be a free standing unit, and can be inserted in any horizontal or vertical void of suitable size. With wheels attached to the bottom panel (16) when it is in vertical position, or to front panel (11) when it is in horizontal position, it can be moved from one place to another more easily, like a suitcase. In the standing position, the wardrobe can be attached to any fixed object (for example the side of a cabinet, wall and the like) thus forming a piece of multi-purpose furniture.

Figure 8:
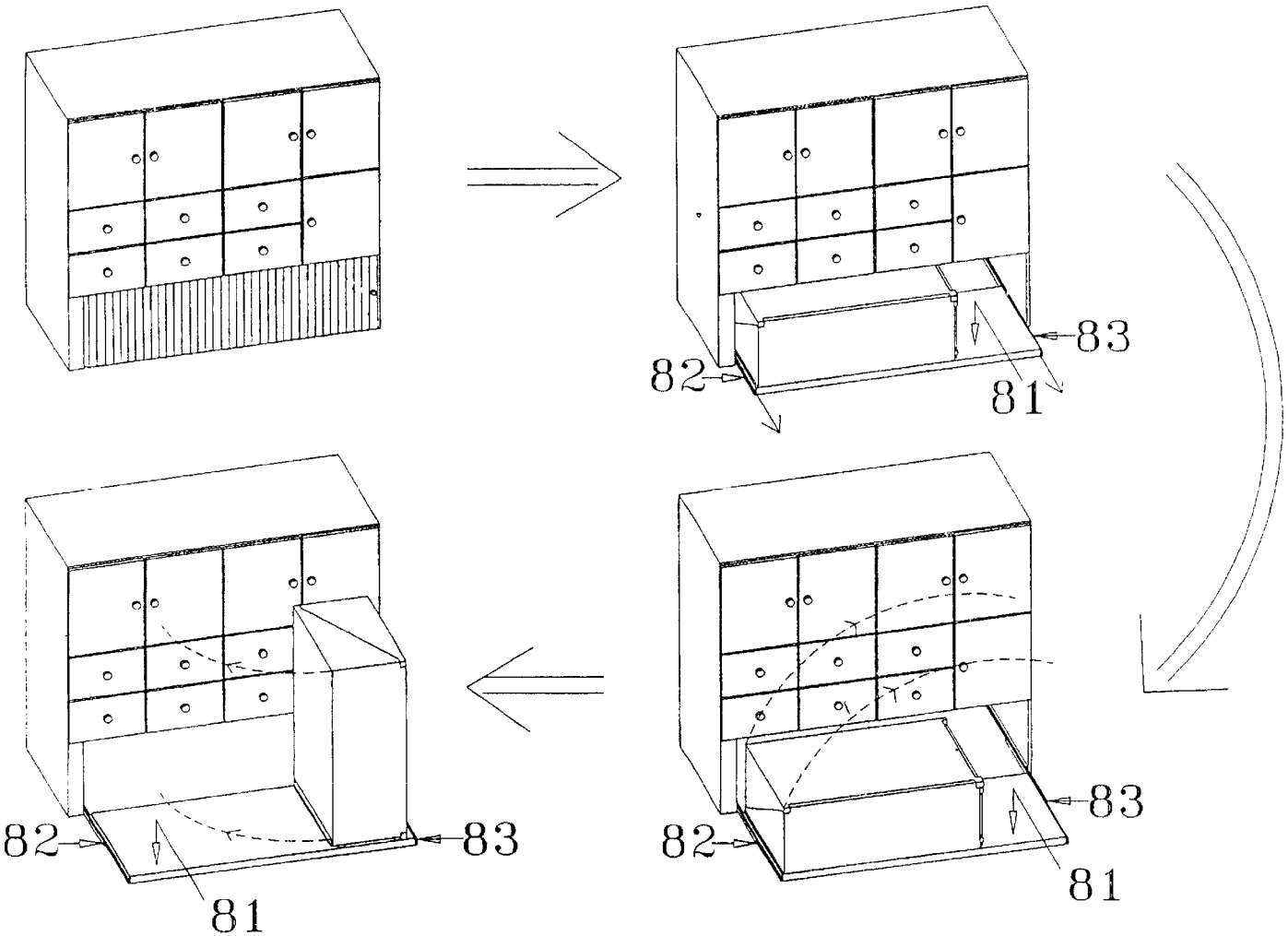
FIG. 8 illustrates a storage system of the invention.
Figure 9:
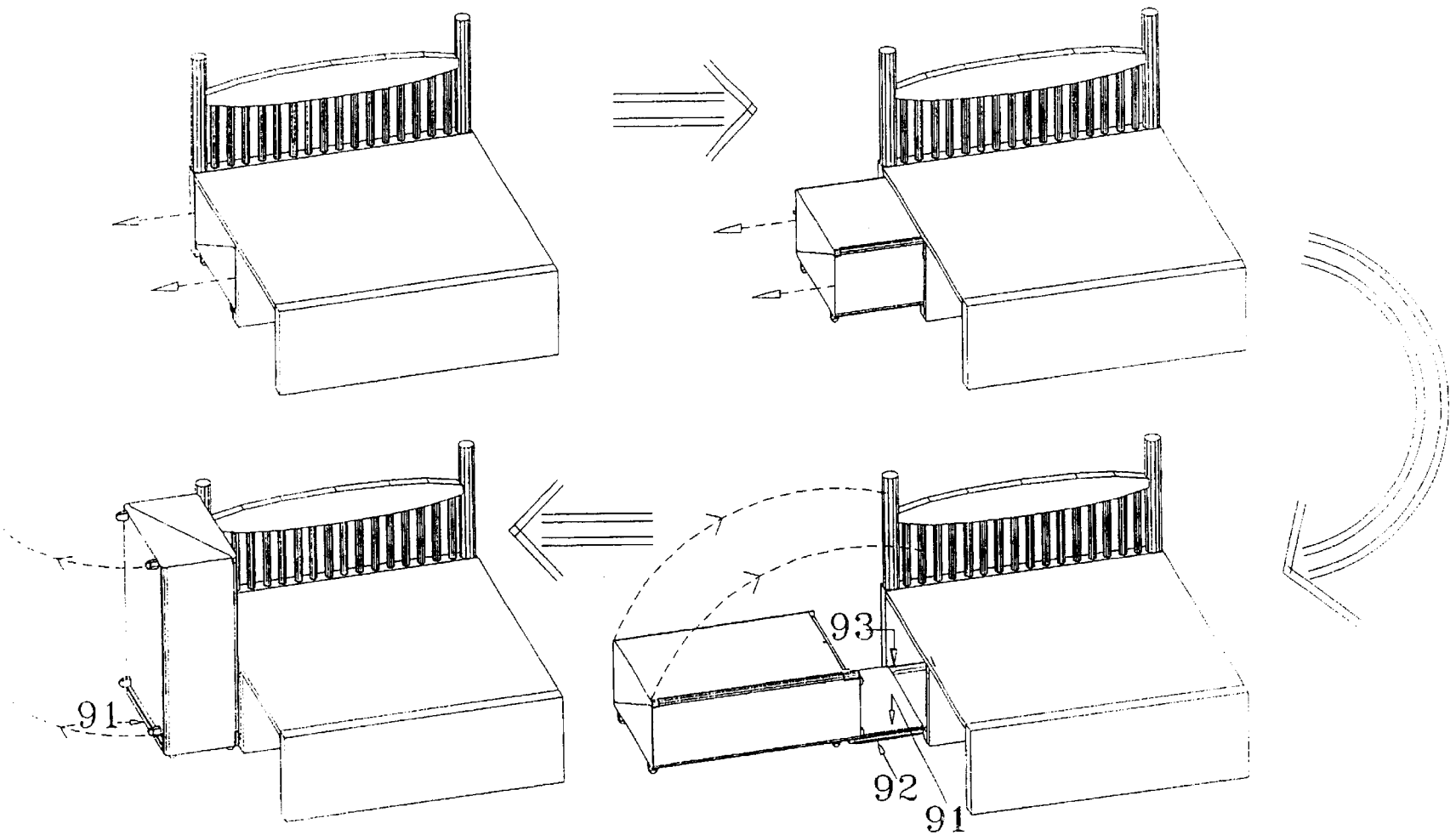
FIG. 9 illustrates an alternative storage system of the invention.

The wardrobe in a fully closed position can be kept as a drawer under a cabinet as shown in FIG. 8. Essentially, the said wardrobe is hinged on a horizontal platform of a carriage assembly (81), where the said wardrobe, in a fully closed condition, can be rotated about the hinge from a vertical to a horizontal orientation and vice-versa. And the platform (81) may be rested on runner tracks (82) and (83) attached to a fixed position under the cabinet. The wardrobe also can be integrated into any void, for instance, under a bed as shown in FIG. 9. The said wardrobe is hinged on a platform of a carriage assembly (91) where the said wardrobe, in fully closed position, can be rotated about the hinge from a horizontal to a vertical orientation and vice-versa. And the platform (91) may be rested on runner tracks (92) and (93) of the carriage assembly (91). As such, when the wardrobe is in lying position, the whole wardrobe acts like a drawer under the bed. When the wardrobe is stored in a lying position, the sheeted objects, in the form of for example, clothes, that were previously hanging in a vertical position, when the wardrobe was in standing position, are in a lying position as well. This means that the clothes are no longer suspended on the hanger, and the effect of prolonged gravity pull on clothes at contact points with a respective hanger is obviated.

Figure 10:
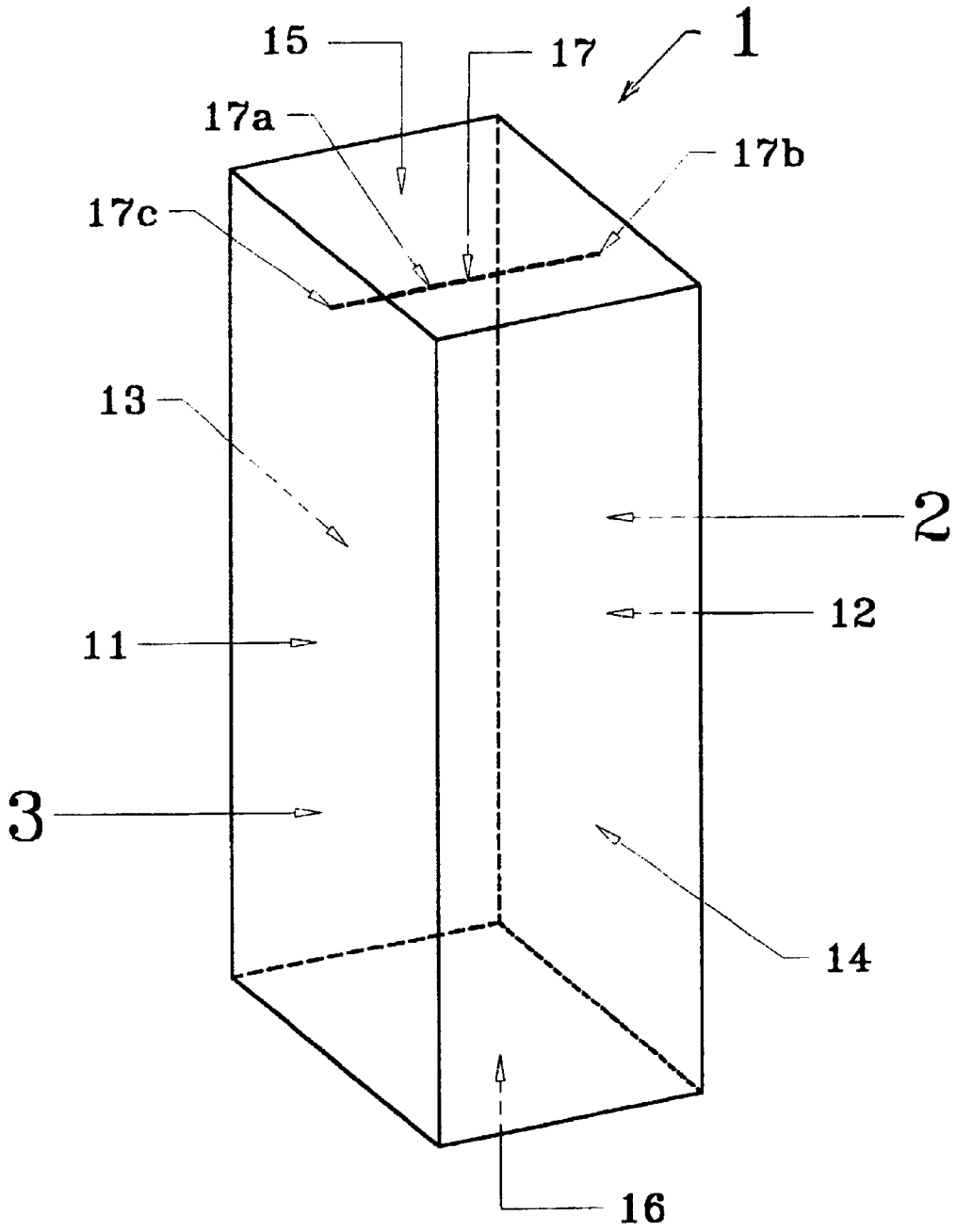
FIG. 10 is a diagrammatic perspective view of a further embodiment of the invention.

Turning now to FIG. 10, where the basic embodiment of a storage unit (1) is again shown in a fully closed condition, and like reference numerals denote like parts to those described above, the unit (1) can be seen as including a first component (2) and a second component (3) coupled to the first component (2) and movable between an open and a closed condition. The unit (1) consists of a front panel (11), a back panel (12), two side panels (13, 14), a roof panel (15) and a base panel (16), forming a rectangular box-like structure, with the first component (2) including at least the back (12) and base panels (16), and the second component (3) including at least the front panel (11). The hanging space of the storage unit (1) in the fully closed condition is defined between the front (11) and back (12) panels. Within the said hanging space, there is at least one (maximum two) collapsible rail assembly (17) which is designed to collapse telescopically to a length fitting into the said hanging space, and all the sheeted objects in the storage unit (1) are hung on this length of rail assembly (17) when the storage unit (1) is in fully closed condition. The rail(s) (17) is perpendicularly fixed to the back panel (12) at one of its ends (17*b*) and it is preferred to be fixed at mid-width of the back panel (12) for the case of one rail assembly so that the space within the storage unit (1) can be utilised most efficiently. End (17*b*) of the rail (17*a*) is also preferred to be fixed at a convenient vertical distance down from the roof panel (15) such that it is sufficient for hung objects to be taken from and put on the said rail assembly (17) without obstruction.

Figure 11:
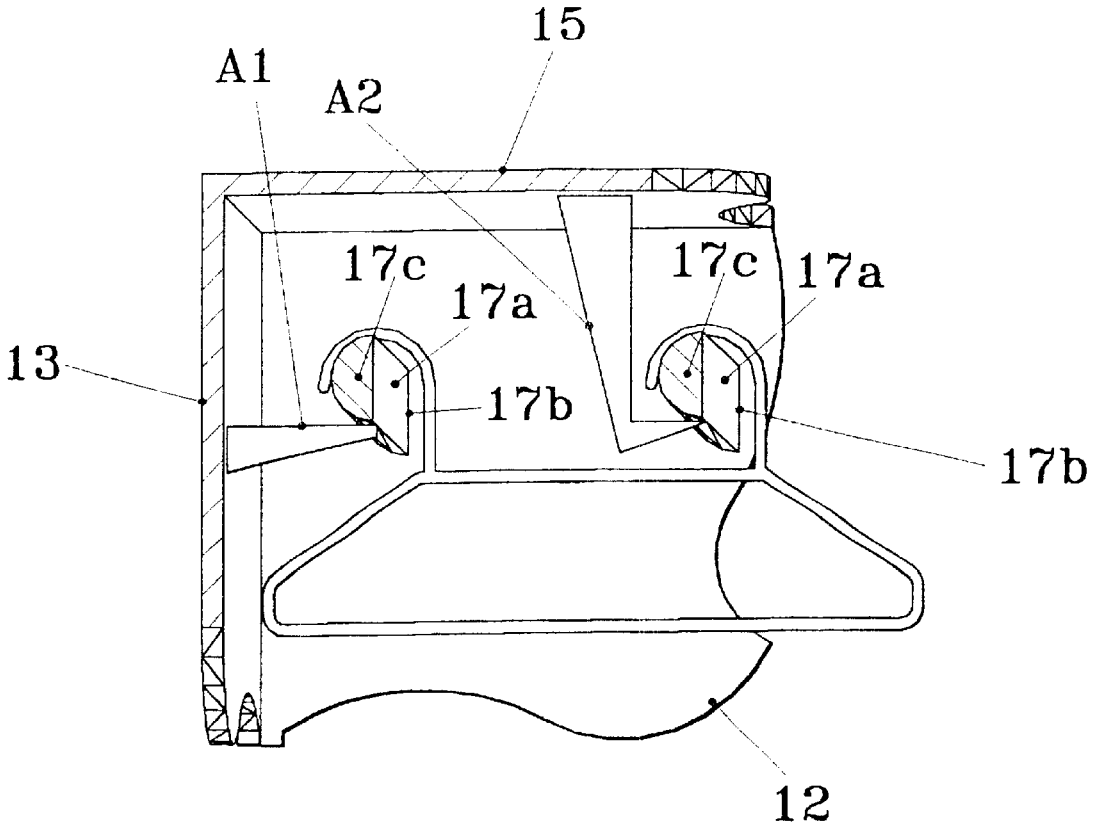
FIG. 11 is a partial cross-sectional view of a unit provided with two rail assemblies.

There can be one or two rail assemblies in a storage unit depending on the stability requirement of the objects hung on the rail(s); an object hung on two rails is more stable than that hung on just one, i.e. an object hung on just one rail is more prone to rotate about the rail hence it is less stable. FIG. 11 shows one of the possible configurations for the storage unit with two rail assemblies. It is preferred to have another support near end (17*c*) of the rail element (17*a*). The said support should be put in such a way that it does not interrupt the smooth sliding of the hung objects along the rail. FIG. 11 shows two possible configurations of support members (A1) and (A2) which are mounted to side panel (13) and roof panel (15) respectively. It can be seen from FIG. 11 that both the supports engage the rail from below to allow the hook of the hanger to slide above it without making any contact with it which is desired for smooth sliding of the hung object along the rails. Although the shape and size of the hooking part of the hangers might vary, bearing the concept shown in FIG. 11 in mind, it is possible to have a support member near rail end (17*c*) which does not obstruct the sliding of hung object. This additional support (either (A1) or (A2)) near rail end (17*c*) reduces greatly the strength requirement of the rail (17*a*) which, without the said support member (A1) or (A2), must be designed as a cantilever fixed on back panel (12). It should be understood that the combination of use of supports (A1) and (A2) shown in FIG. 11 is just a suggestion, other combinations such as (A1) and (A1), (A2) and (A2) can be used as well. A similar design principal applies for the case where the storage unit has only one rail assembly. The rail assembly can be either supported by (A1) or (A2).

Figure 12:
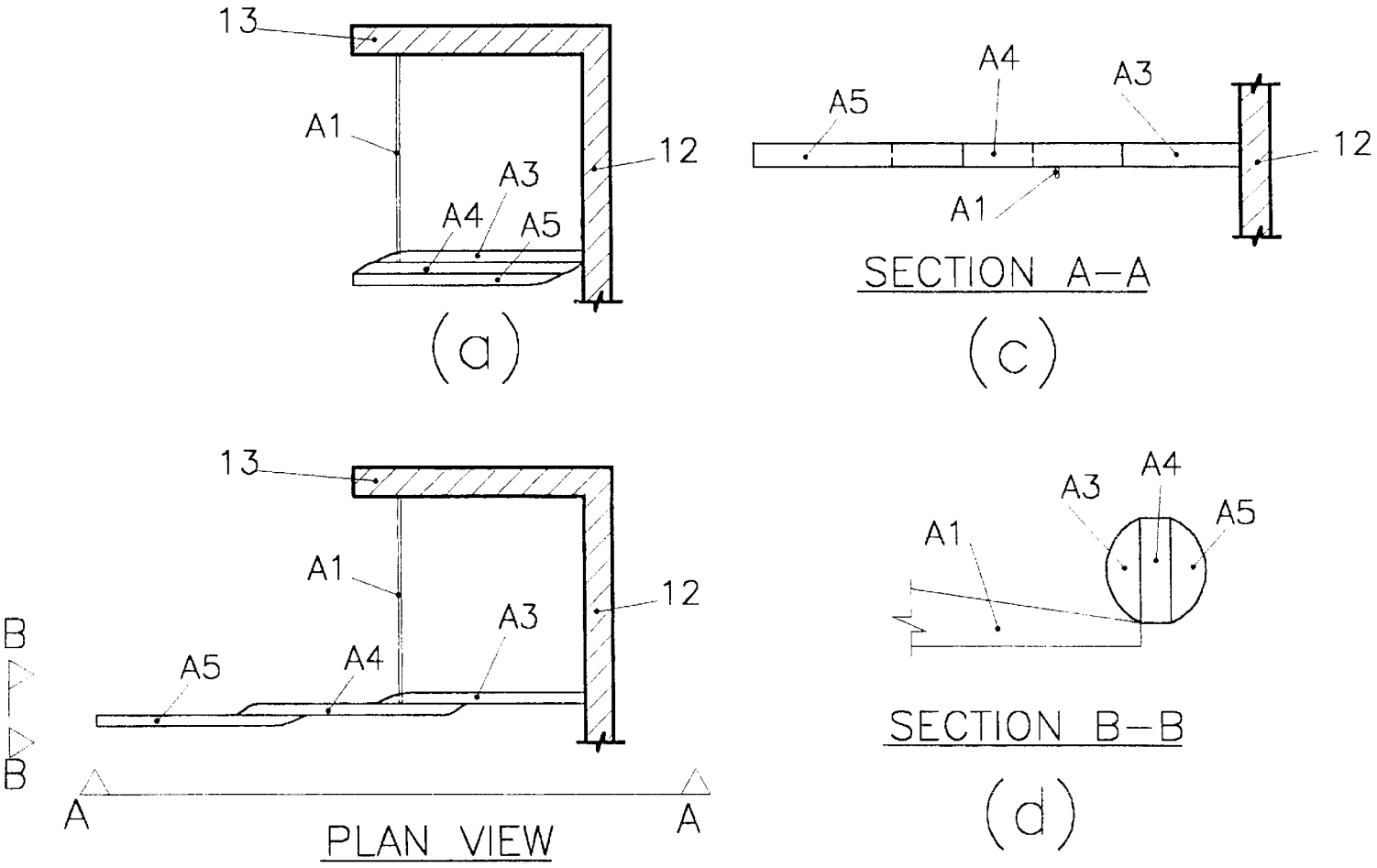
FIG. 12 illustrates a telescopic rail assembly.
Figure 13:
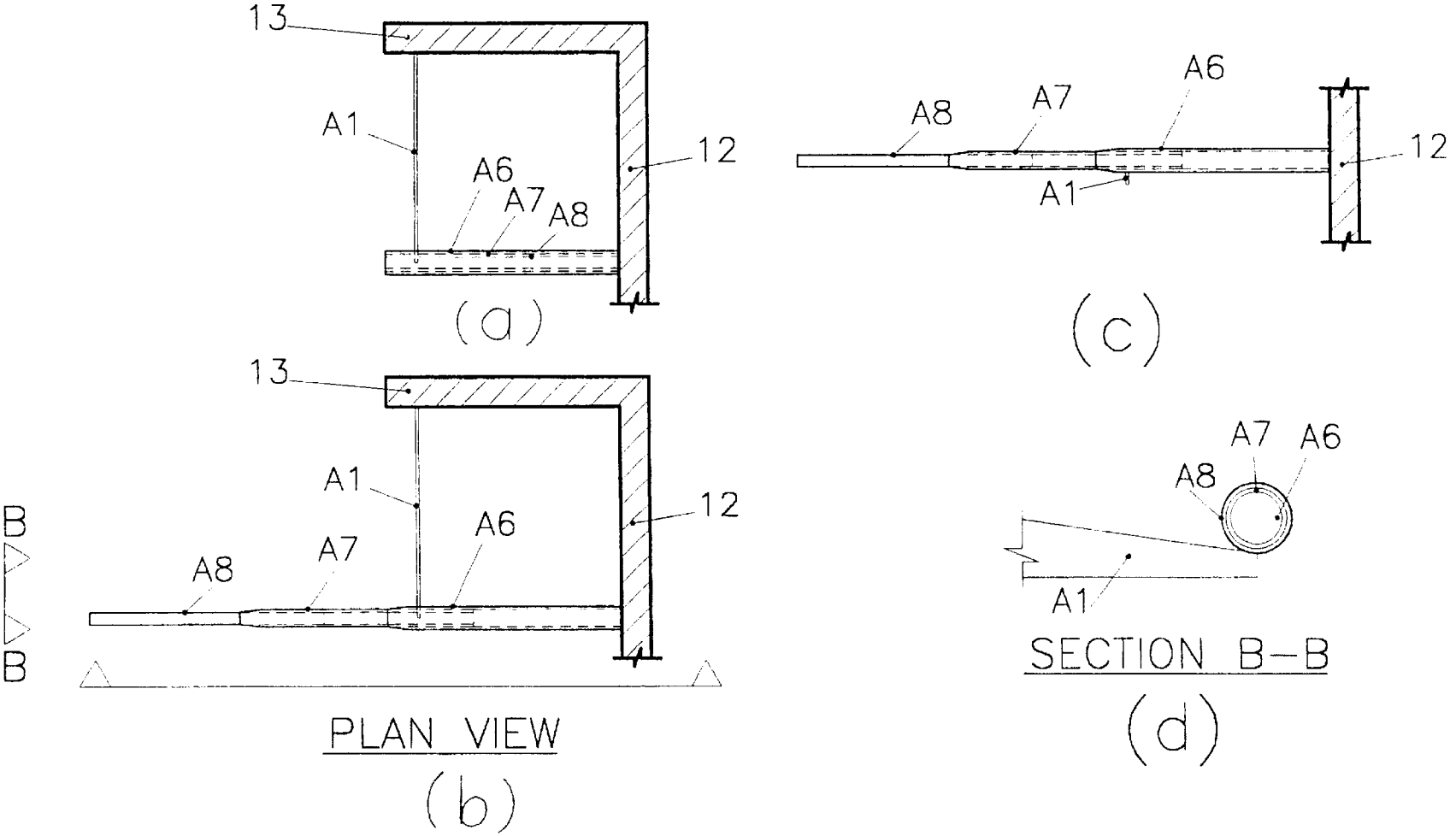
FIG. 13 illustrates another telescopic rail assembly.

FIG. 12 shows one of the possible configurations of a telescopically extendible rail assembly (17). FIG. 12(*a*) shows the rail assembly in fully collapsed condition. It has three elements (A3), (A4) and (A5) with (A3) analogous to (17*a*) of FIG. 11. All the elements (A3), (A4) and (A5) are able to slide one over another so that the rail assembly can be made longer as shown in FIG. 12(*b*). To ensure smooth sliding of hung objects along the extended rail, the end of rail element which attaches to the other rail element must be tapered as shown in FIG. 12(*b*), and the topmost surfaces of all the rail elements (A3), (A4) and (A5) is preferred to be at the same level as shown in FIGS. 12(*c*) and 12(*d*). FIG. 13 shows another possible configuration of a rail assembly which has a conventional telescopic rod which has three elements (A6), (A7) and (A8) with (A6) analogous to (17A). FIGS. 12(*a*) and (*b*) show the rail assembly in fully collapsed and extended conditions respectively. FIGS. 12(*c*) and (*d*) shows the section details of the rail assembly. The rail assemblies shown in FIGS. 12 and 13 need not necessarily be limited to three elements, and can have two or four or more elements depending on the extended length required.

Figure 14:
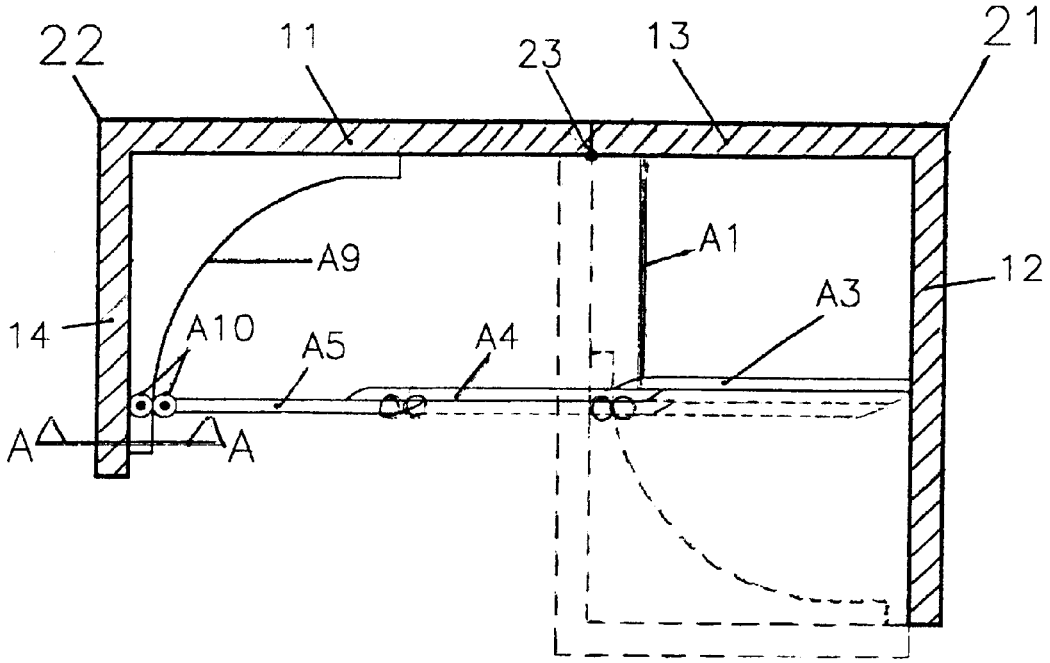
FIG. 14 illustrates a guide track and roller used for coupling a rail assembly of the invention to a second component.
Figure 14:
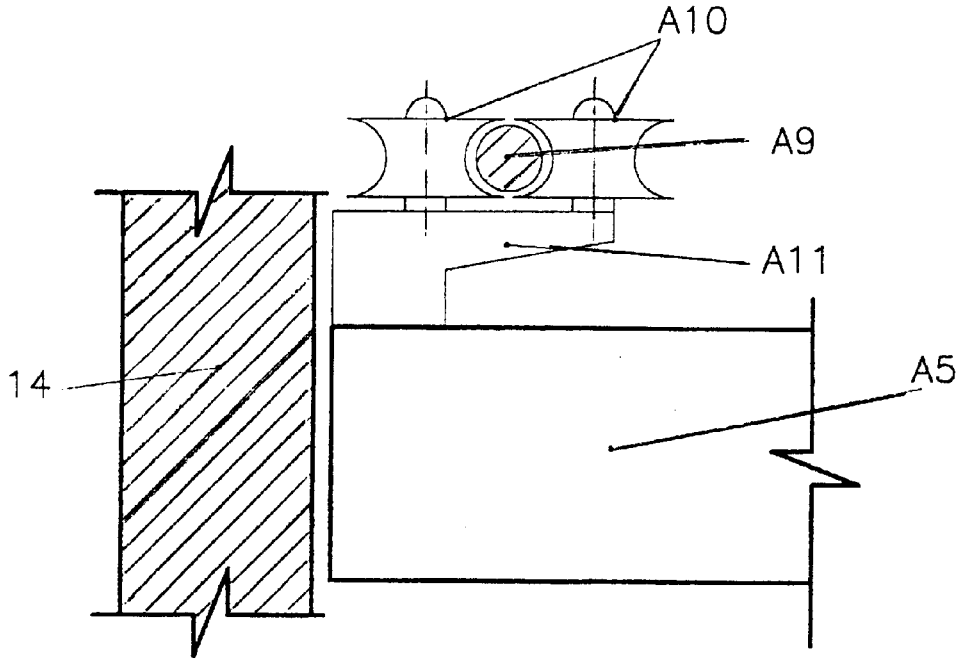

In order to make use of the telescopically extendible rail assembly in embodiment (20) shown in FIG. 12 in a more user-friendly manner, it is suggested here that there should be a curved track (A9) attached to door unit (22) and a pair of rollers (A10) attached to the end of rail element (A5) as shown in FIG. 14. FIG. 14(*a*) shows the plan view of embodiment (20) with telescopically extendible rail assembly. It can be seen that as the door unit (22) swings from closed to fully open position, the curved track (A9), which may be made of metal rod, pulls the rollers (A10) which are attached to the end of rail element (A5). This makes the rail assembly extend automatically as the door unit (22) is opening and vice-versa. FIG. 14(*b*) shows the closed up section details of the roller assembly. The rollers (A10) are mounted on a small platform (A11) which is of the shape of inverted "L" and attached to end of rail element (A5). There is a gap between platform (A11) and rail element (A5) to maximise the utilisation of the rail assembly for hanging especially when the storage system is in fully closed condition.

Figure 15:
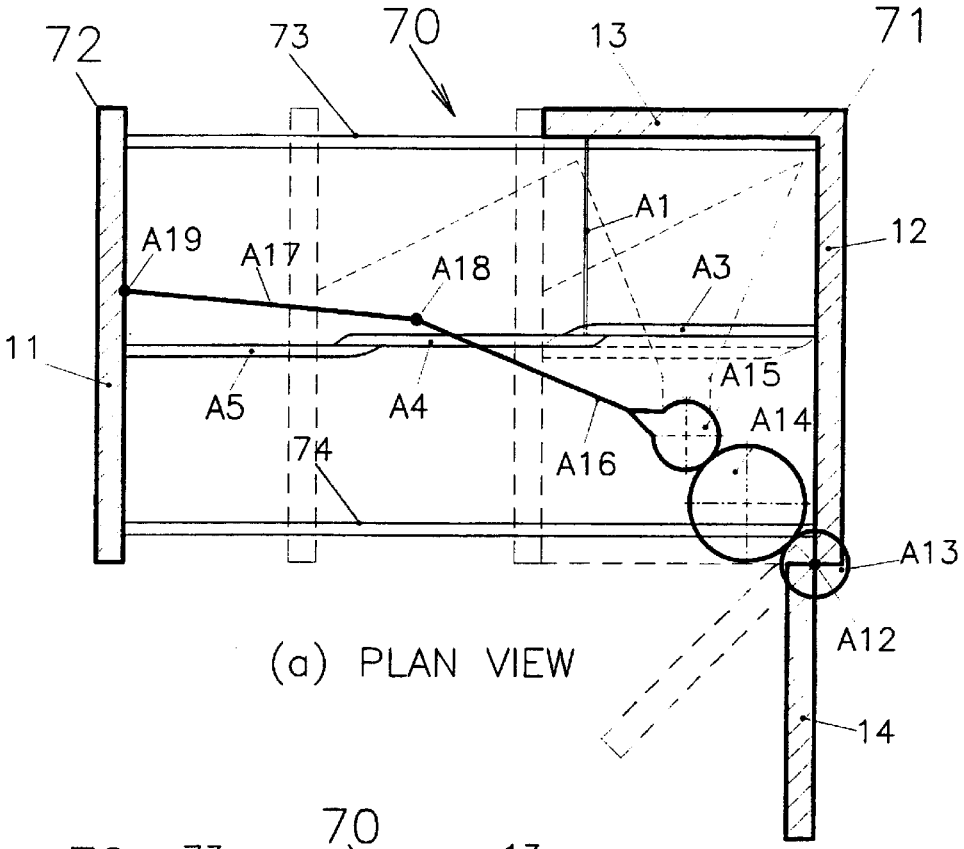
FIG. 15 illustrates a linkage mechanism coupling a panel to a second component of a unit of the invention.
Figure 15:
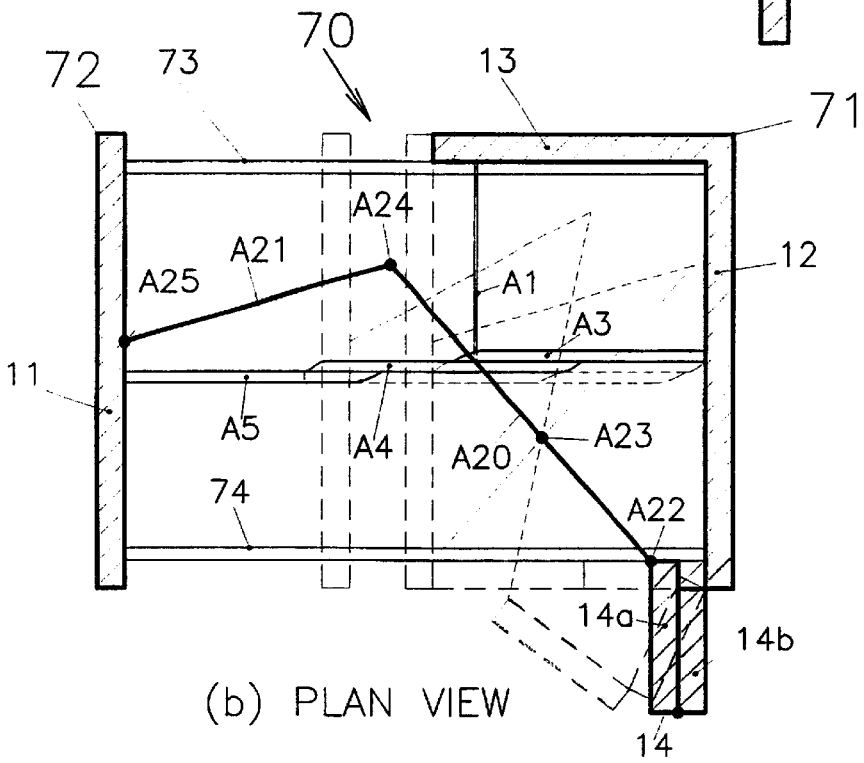
Figure 15:
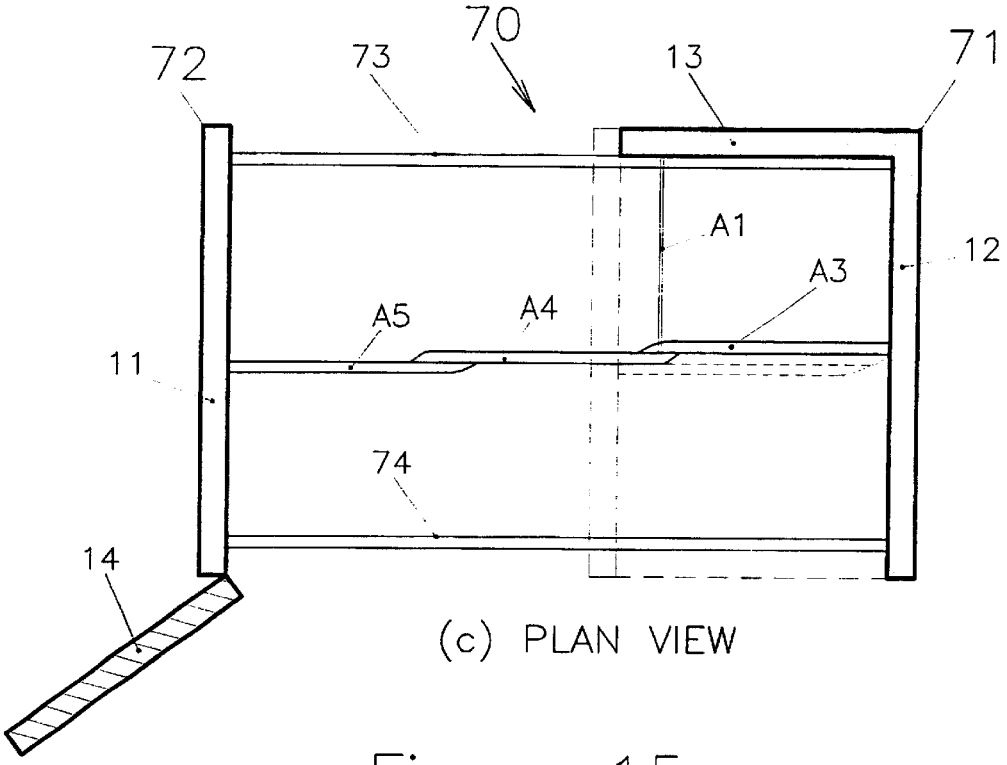

There are, however, some shortcomings with the configuration shown in FIG. 14. For example, the user needs to ensure all the sheeted objects are hung within the hanging space defined when the storage system is in fully closed condition before the door unit (14) is closed from fully open condition. Without doing so, the closing action of the door unit (22), which swings about axis (23), tends to push the objects hung on the extended portion of the rail assembly making the hung objects swing about the rail which in turn results in crumpling of the hung object. In some cases, this will hinder the closing of the door unit (22) as well. Because of that, it is desired to have a door closing action which is parallel to the sliding action of the hung objects so that when the door is closing, it can collapse the rail assembly and concurrently push the hung objects towards back panel (12). Eventually, when the door is closed, the rail assembly will be fully collapsed and the hung objects will be within the hanging space defined when the storage system is in fully closed condition. The door unit (72) of embodiment (70) shown in FIG. 15 exhibits this property. FIG. 15 shows the details of embodiment (70) which is provided with a telescopically extendible rail assembly. It is preferred to have side panel (14) acting as a door so that when it is opened it creates an additional opening to facilitate the browsing through, taking out or hanging of hung objects when the storage system is open. FIG. 15(*a*) shows one of the possible configurations of side panel (14) acting as door which is joined to back panel (12) through hinge (A12). To make the system more user-friendly, it is suggested here that the rotational motion of side panel (14) be utilised to open front panel (11). In such a way, the system is opened with just the side panel (14) being rotated. FIG. 15(*a*) shows one of the possible mechanisms to achieve this. The mechanism consists of gear (A13) centered at (A12) and fixed to side panel (14) such that when panel (14) rotates, the gear (A13) rotates. Gear (A15), which is mounted on component (71), connects to gear (A13) through gear (A14) which is also mounted on component (71). Thus, gear (A15) rotates the same direction as gear (A13). There are two arms (A16) and (A17) which are connected by hinge (A18). The other end of arm (A16) is mounted to gear (A15) such that when gear (A15) rotates, arm (A16) rotates and the other end of arm (A17) is hinged to front panel (11) at (A19). With the above-mentioned connectivity, when side panel (14) is opened/closed, it opens/closes front panel (11). On the other hand, the opening/closing of front panel (11) also opens/closes side panel (14). With suitable selection of the sizes and locations of gears (A13), (A14) and (A15), the geometry of arms (A16) and (A17), and the location of hinge (A17), it is possible to decide the maximum extent to which the storage system is open.

FIG. 15(*b*) shows another configuration in which the side panel (14) comprises two panels (14*a*) and (14*b*), designed as a folding door. It is preferred to use the folding action of panel (14) to fully open or close the storage system. FIG. 15(*b*) shows one of the possible mechanisms to achieve this. The mechanism consists of two arms (A20) and (A21). Arm (A20) connects to panel (14*a*) at one end through hinge (A22), to component (71) at the body through hinge (A23) and to end of arm (A21) at the other end through hinge (A24). The other end off arm (A21) connects to front panel (11) through hinge (A25). Therefore, the folding action of panel (14) will open front panel (11) and vice-versa. Likewise, the closing/opening of front panel (11) will unfold/fold panel (14). With suitable selection of the geometry of arms (A20) and (A21), and the locations of hinges (A23) and (A25), it is possible to decide the maximum extent to which the storage system is open. It is understood that the two mechanisms mentioned above are just suggestions, and that any workman of skill may employ with other mechanisms using commonly available mechanical parts to achieve the same result, that is to have the system fully closed or open by just the rotating/folding motion of side panel (14). Alternatively, side panel (14) can be hinged to front panel (11) as shown in FIG. 15(*c*). In such a way, the storage system can be opened/closed by pulling side panel (14) to the left/right.

Figure 16:
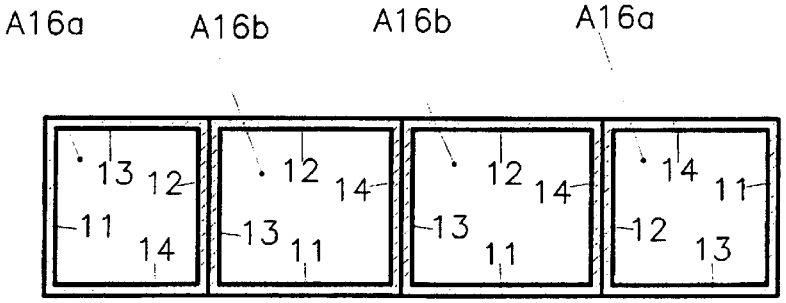
FIG. 16 is a plan view of a furniture system incorporating a unit of the invention.
Figure 17:
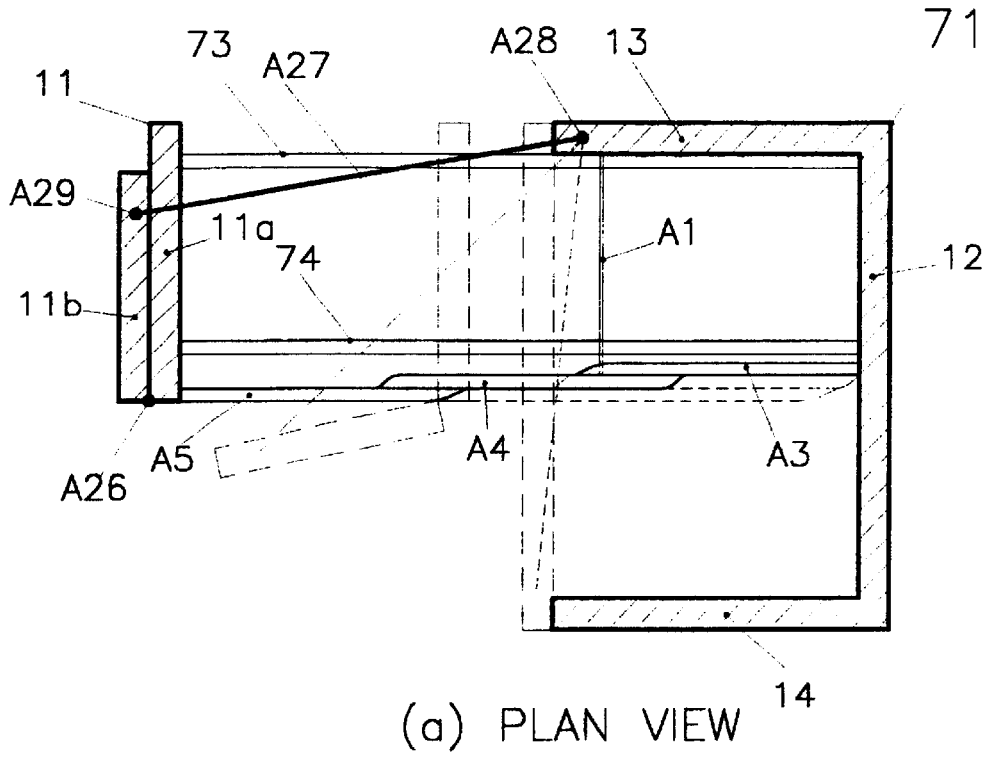
FIGS. 17 to 19 illustrate alternative linkage mechanisms of the invention.
Figure 17:
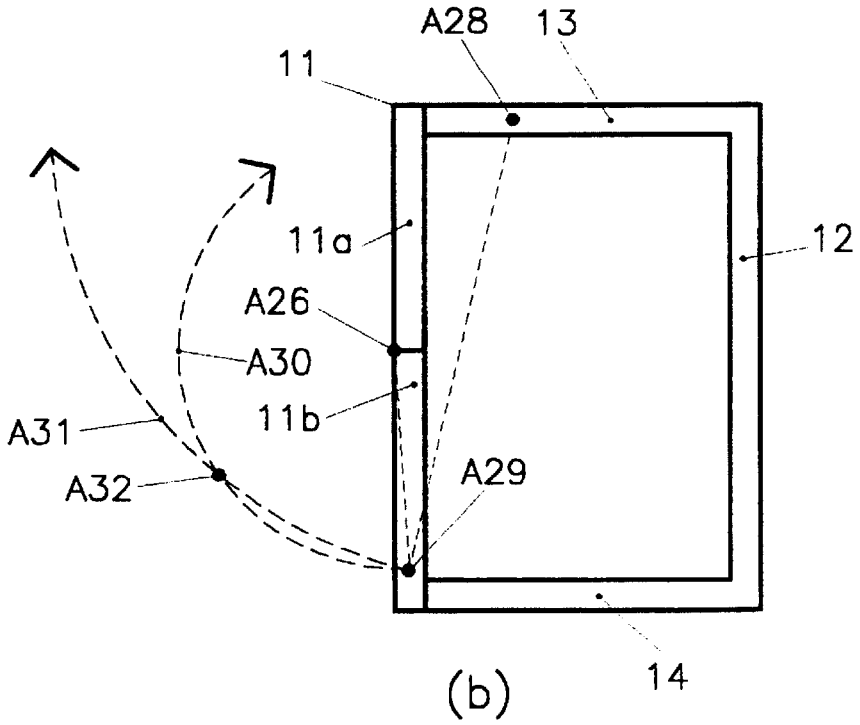

The embodiments shown in FIGS. 14 and 15 are suitable for the case when the storage system is a free standing unit or an end unit (A16*a*), as shown in FIG. 16, of a furniture system. The above described unit is not suitable to be a middle unit (A16*b*) because side panel (14) is not permissible to open as a door hence the accessibility to hung objects is obstructed. In view of that, the front panel (11) is preferred to be modified such that it consists of two smaller panels (11*a*) and (11*b*) as shown in FIG. 17(*a*). Metal slide (74) is to shift horizontally towards panel (13) so that it is able to support panel (11*a*) and leave panel (11*b*) to move freely. Therefore, the slides (73), (74) and rail assembly are attached to panel (11*a*) at one end and first component (71) at the other end. FIG. 17(*a*) shows one possible arrangement of the two panels (11*a*) and (11*b*) where panel (11*b*) is connected to panel (11*a*) through hinge (A26) so that panel (11*b*) is able to rotate in a horizontal plane. When the storage system is fully opened, panel (11*b*) can be rotated to the front of panel (11*a*) and hence an additional opening is created which increases the accessibility to the hung objects. To make the storage system more user-friendly, it is preferred to utilise the rotational action of panel (11*a*) about hinge (A26) to open or close the storage system. An additional swinging arm (A27) may connect to first component (71) through hinge (A28) at one end and to panel (11*b*) through hinge (A29) at the other end as shown in FIG. 17(*a*). This will enable the storage unit to be opened to the configuration shown in FIG. 17(*a*) with just the rotating action of panel (11*b*) about hinge (A26). The arm (A27) is preferred to be slightly extendible so that the rotating action of panel (11*b*) about hinge (A26) can be established. FIG. 17(*b*) shows two initial rotating paths (A30) and (A31) of panel (11*b*) and arm (A27) respectively. It should be noted that path (A30) is movable horizontally and parallel to side panel (13) relative to embodiment (71), and (A31) is fixed relative to embodiment (71). It can be seen that path (A30) initially travels further from the rotation path (A31) relative to hinge (A28). This means that in order to initiate the mechanism of opening by rotating panel (11*b*) about hinge (A26), panel (11*a*) has to travel towards panel (12) first which is not permissible, and thus the mechanism could not be initiated. If some provisional extension is provided for arm (A27) along the straight line joining (A26) and (A28) to overcome the portion where path (A30) travels further from path (A31), then panel (11*b*) is able to rotate about hinge (A26) and the mechanism can be initiated. When panel (11*b*) rotates beyond point (A32), after which path (A30) travels shorter than path (A31) relative to hinge (A28), the rotational motion of panel (11*b*) about hinge (A26) will pull panel (11*a*) to the left. Finally, the storage system will be fully open when panel (11*b*) rotates to its maximum as shown in FIG. 17(*a*). With suitable selection of the geometry of arm (A27) and the locations of hinges (A28) and (A29), it is possible to decide the maximum extent to which the storage system is opened.

Figure 18:
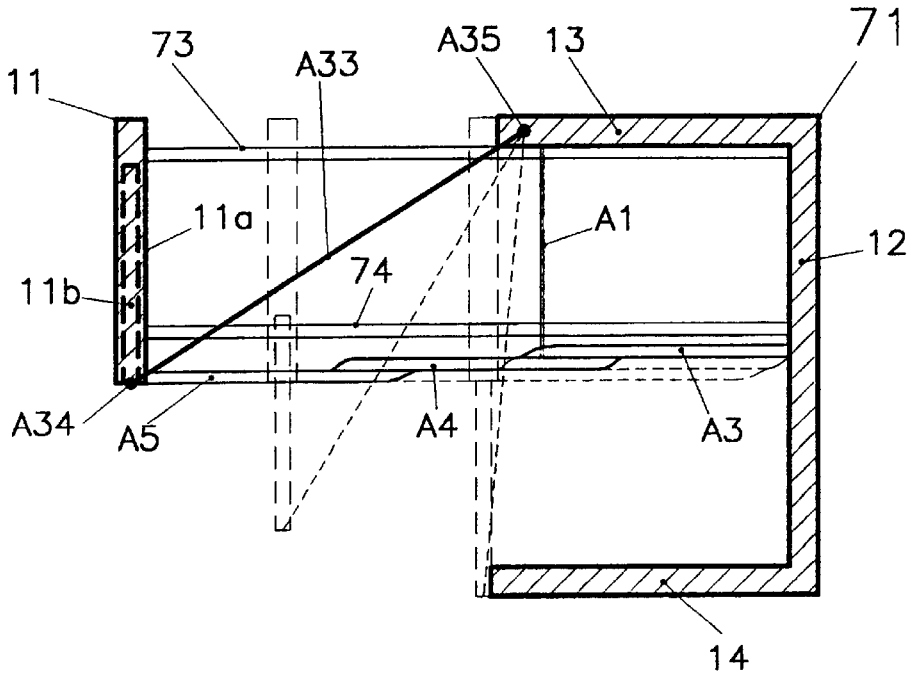

FIG. 18 shows another possible arrangement of panels (11*a*) and (11*b*). In this instance, panel (11*b*) is designed to be able to slide along panel (11*a*) and hence the same extent of opening is provided as for the embodiment shown in FIG. 17 when the system is fully opened. It is preferred to provide a swinging arm (A33) which connects panel (11*b*) at one end through hinge (A34) and to embodiment (71) at the other end through hinge (A35). In this case, the system is opened by pulling panel (11*a*) to the left and this action leads to the rotating of arm (A33) which in turn forces panel (11*b*) to slide towards panel (11*a*). Thus, when the storage system is fully opened, it looks like that shown in FIG. 18. With suitable selection of the geometry of arm (A33) and the location of hinge (A35), it is possible to decide the maximum extent to which the storage system is open.

Figure 19:
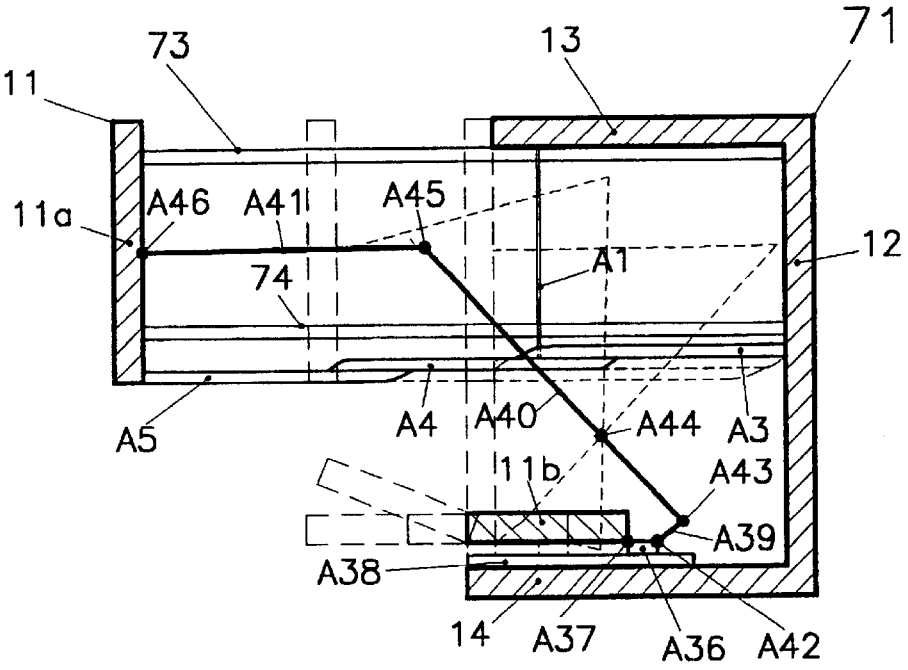

Beside having panel (11*b*) attached to panel (11*a*), panel (11*b*) can be attached to component (71). As shown in FIG. 19, panel (11*b*) attaches to a slide (A36) through hinge (A37). The slide (A36) slides along track (A37) which is mounted to embodiment (71). Therefore panel (11*b*) can be opened by rotating it such that it is parallel to side panel (14), and subsequently sliding it into embodiment (71) as shown in FIG. 19. This creates same opening as that shown in FIG. 17 when the storage system is fully open. To make it more user-friendly, a mechanism may be included such that when panel (11*a*) is opened, it opens the whole system. FIG. 19 shows one of the possible arrangements of the mechanism which consists of three arms (A39), (A40) and (A41). Arm (A39) connects to slide (A36) through hinge (A42) at one end and to end of arm (A40) through hinge (A43) at the other end. Arm (A40) connects to embodiment (71) through hinge (A44) at the body and to the end of arm (A41) through hinge (A44) at the other end. Arm (A41) connects to panel (11*a*) through hinge (A46) at the other end. It can be observed from FIG. 19 that when panel (11*b*) slides into embodiment (71), it rotates arm (A40) through arm (A39) about hinge (A44). In turn, the rotation of arm (A40) pushes panel (11*a*) to the left through arm (A41) and the storage system is opened. With suitable selection of the geometry of arms (A39), (A40) and (A41), and the location of hinge (A44), it is possible to decide the maximum extent to which the storage system is opened. It is understood that the above-mentioned mechanisms to facilitate the opening of the storage system shown in FIGS. 17, 18 and 19 are just suggestions, and any workman of skill may substitute other mechanisms using commonly available mechanical parts to achieve the same results, whilst still falling within the scope of the invention.

Finally, it is to be understood that the inventive concept in any of its aspects can be incorporated in many different constructions so that the generality of the preceding description is not to be superseded by the particularity of the attached drawings. Various alterations, modifications and/or additions may be incorporated into the various constructions and arrangements of parts without departing from the spirit or ambit of the invention.

What is claimed is:

1. A storage system, comprising:

a first component having a rear panel and two side panels for providing a hanging space for receipt of sheeted objects;

a second component having a front panel adapted to couple to the first component to define a storage unit, the front panel mounted on a track for movement between an open and a closed condition in a direction perpendicular to the rear panel; and a rail assembly, including a main rail coupled to the first component at one end, for hanging the sheeted objects therefrom when the second component is in the closed condition and an extension portion coupled to the second component at the other end, the extension portion being coupled to and extendible relative to the main rail upon movement of the second component toward the open condition, whereby the rail assembly is in an extended condition, so as to increase the effective length of the rail assembly and thereby increase the hanging space for the sheeted objects to allow the sheeted objects to slide onto the extension portion in order to spread the sheeted objects along the rail assembly when the second component is in an open condition.

2. A system as claimed in claim 1, wherein at least one of the components is provided with roller support.

3. A system as claimed in claim 2, wherein the roller support is provided on the second component.

4. A system as claimed in claim 1, including a carriage assembly upon which the storage unit is mounted, the assembly allowing the storage unit to pivot from an upright to a horizontal orientation and to be subsequently horizontally displaced for storage.

5. A system as claimed in claim 4, wherein the carriage assembly includes a platform, to which the storage unit is hingedly coupled for movement between the upright and horizontal orientations and guide rails along which the platform slides for it to effect horizontal displacement of the storage unit.

6. A system as claimed in claim 1, wherein a second rail assembly is coupled to the first component and arranged to extend, when the second component is in an open condition, substantially parallel to the first rail assembly.

7. A system as claimed in claim 1, wherein the storage unit includes at least one panel arranged for movement to enhance access to the sheeted objects hanging within the storage unit and coupled to the second component via a linkage opening mechanism such that movement of the panel results in corresponding movement of the second component toward the open condition.

8. A system as claimed in claim 1, wherein the main rail of the rail assembly is supported at another end by a support member connected to the first component, the support member engaging the main rail from an underside thereof so as not to inhibit sliding movement of a hanger between the main rail and the extension portion.

9. A system as claimed in claim 1, wherein the extension portion is telescopically extendible relative to the main rail.

10. A storage system, comprising:

a first component for providing a hanging space for receipt of sheeted objects;

a second component adapted to couple to the first component to define a storage unit and movable between an open and a closed condition; and a rail assembly, including a main rail coupled to the first component at one end, for hanging the sheeted objects therefrom when the second component is in the closed condition and an extension portion coupled to the second component at the other end, the extension portion being extendible relative to the main rail upon movement of the second component toward the open condition, whereby the rail assembly is in an extended condition, so as to increase the effective length of the rail assembly and thereby increase the hanging space for the sheeted objects to allow the sheeted objects to slide onto the extension portion in order to spread the sheeted objects along the rail assembly when the second component is in an open condition, wherein the extension portion comprises an articulated construction formed of at least one rail element pivotally connected to the main rail.

11. A system as claimed in claim 10, wherein a plurality of rail elements are provided, the elements being arranged to pivot in a substantially horizontal plane and fold into the space provided by the first component when the second component is in the closed condition.

12. A system as claimed in claim 11, wherein one of the elements, remote from the main rail when the extension portion is extended, is fixed in relation to the second component.

13. A system as claimed in claim 11, wherein one of the elements, remote from the main rail when the extension portion is extended, is pivotally coupled to the second component.

14. A system as claimed in claim 13, wherein said one of the elements is 'L'-shaped and coupled to the second component adjacent a free edge thereof to hold a remainder of the rail assembly in spaced relation from the second component when the second component is in the open condition.

15. A system as claimed in claim 10, wherein the second component is moved to the open condition by rotating relative to the first component and includes a guide track for receiving a roller provided at an end of the extension portion, to allow the extension portion to extend linearly during relative rotation of the second component while maintaining coupling therebetween.

16. A system as claimed in claim 10, wherein the at least one element is arranged to pivot in a substantially vertical plane.

17. A system as claimed in claim 10, wherein the first component includes a rear panel, a side panel, and at least a roof portion of the storage unit and the second component is in the form of a front panel, pivotally attached to the first component and includes a side panel and another roof portion whereby, in a closed condition, the roof portions of the first and second components provide a full roof panel.

18. A system as claimed in claim 17, wherein the cast component is pivotally attached to the second component by a hinge connection provided between the side panel of the first component and the front panel of the second component.

19. A system as in claim 10, wherein the first component includes a base panel and a rear panel, and the second component includes a front panel, hingedly attached to the base panel.

20. A system as claimed in claim 19, wherein a support structure is provided for supporting the extension portion above the front panel when the second component is in an open condition.

21. A system as claimed in claim 20, wherein the support structure includes a strut, pivotally mounted to the second component and pivotal from a storage position, when the second component is in a closed condition, to a supporting condition, extending in a substantially upright manner with respect to the front panel.

* * * * *